US011322063B2

(12) United States Patent
Chen et al.

(10) Patent No.: US 11,322,063 B2
(45) Date of Patent: May 3, 2022

(54) SCAN DRIVING CIRCUIT AND DRIVING METHOD THEREOF, AND DISPLAY DEVICE

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Shuai Chen, Beijing (CN); Zhi Zhang, Beijing (CN); Xiuzhu Tang, Beijing (CN); Heecheol Kim, Beijing (CN); Xing Dong, Beijing (CN); Zhenguo Tian, Beijing (CN); Shuang Hu, Beijing (CN); Taoliang Tang, Beijing (CN); Jingpeng Zhao, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 885 days.

(21) Appl. No.: 16/082,071

(22) PCT Filed: Jan. 24, 2018

(86) PCT No.: PCT/CN2018/074002
§ 371 (c)(1),
(2) Date: Sep. 4, 2018

(87) PCT Pub. No.: WO2019/015289
PCT Pub. Date: Jan. 24, 2019

(65) Prior Publication Data

US 2021/0225226 A1 Jul. 22, 2021

(30) Foreign Application Priority Data

Jul. 18, 2017 (CN) ..... 201710585221.3

(51) Int. Cl.
*G09G 3/20* (2006.01)

(52) U.S. Cl.
CPC ..... *G09G 3/20* (2013.01); *G09G 2300/0819* (2013.01); *G09G 2310/0213* (2013.01); *G09G 2310/0283* (2013.01); *G09G 2340/16* (2013.01)

(58) Field of Classification Search
CPC ..... G09G 3/20; G09G 2300/0819; G09G 2310/0213; G09G 2310/0283; G09G 2340/16
See application file for complete search history.

(56) References Cited

U.S. PATENT DOCUMENTS 5,850,216 A 12/1998 Kwon
2004/0239659 A1* 12/2004 Toriumi ..... G09G 3/3688 345/204

(Continued)

FOREIGN PATENT DOCUMENTS

CN 101866633 A 10/2010
CN 102063876 A 5/2011
CN 106710562 5/2017

OTHER PUBLICATIONS

The Third Chinese Office Action dated Dec. 30, 2019; Appln. No. 201710585221.3.

(Continued)

*Primary Examiner* — Carolyn R Edwards
*Assistant Examiner* — Eboni N Giles

(57) ABSTRACT

A scan driving circuit and a driving method thereof, and a display device are disclosed. The scan driving circuit includes: a control circuit, a scanning circuit group and a first processing circuit group. The control circuit is configured to generate and output a keyword signal to the first processing circuit group, to control a scan order of respective scanning circuits in the scanning circuit group; the first (Continued)

processing circuit group is configured to generate a scan enable signal according to the keyword signal, and output the scan enable signal to a scanning circuit corresponding to the keyword signal in the scanning circuit group.

20 Claims, 15 Drawing Sheets

(56) References Cited

U.S. PATENT DOCUMENTS

| | | | | |
|---|---|---|---|---|
| 2005/0093810 | A1* | 5/2005 | Ito | G09G 3/20 345/100 |
| 2011/0102414 | A1* | 5/2011 | Lin | G09G 3/3648 345/213 |
| 2014/0313108 | A1* | 10/2014 | Kim | G09G 3/3266 345/76 |
| 2015/0145842 | A1* | 5/2015 | Maeda | G09G 3/2092 345/208 |

OTHER PUBLICATIONS

International Search Report and Written Opinion dated Apr. 20, 2018; PCT/CN2018/074002.
The Extended European Search Report dated Feb. 25, 2021; Appln. No. 18758797.7.

* cited by examiner

SCAN DRIVING CIRCUIT AND DRIVING METHOD THEREOF, AND DISPLAY DEVICE

The present application claims priority to Chinese patent application No. 201710585221.3, filed on Jul. 18, 2017, the entire disclosure of which is incorporated herein by reference as part of the present application.

TECHNICAL FIELD

Embodiments of the present disclosure relate to a scan driving circuit and a driving method thereof, and a display device.

BACKGROUND

Driving modes for a display panel mainly include an active matrix driving mode and a passive matrix driving mode. A main feature of the active matrix driving mode is to configure one active component for each pixel unit, to separately control each pixel unit. The active matrix driving mode has advantages such as low driving voltage, low power consumption, short response time, applicability to high-definition and large-sized display, and the like.

With development of a display technology, a display using an active matrix driving technology is getting matured day by day. Scanning modes of a gate active drive scanning circuit of the display are all co-directional sequential scanning, for example, progressive scanning or interlaced scanning, so that display frequencies of all display regions on the display panel of the display are fixed.

SUMMARY

At least an embodiment of the present disclosure provides a scan driving circuit, which comprises: a control circuit, a scanning circuit group and a first processing circuit group. The control circuit is configured to generate and output a keyword signal to the first processing circuit group, to control a scan order of respective scanning circuits in the scanning circuit group; and the first processing circuit group is configured to generate a scan enable signal according to the keyword signal, and output the scan enable signal to a scanning circuit corresponding to the keyword signal in the scanning circuit group.

At least an embodiment of the present disclosure further provides a display device, which comprises a display panel and the scan driving circuit according to any one of the embodiments of the present disclosure.

At least an embodiment of the present disclosure further provides a driving method for the scan driving circuit according to any one of the embodiments of the present disclosure, comprising: generating and outputting a keyword signal; and generating a scan enable signal according to the keyword signal, the scan enable signal being used for selecting a scanning circuit corresponding to the keyword signal to perform a scan operation.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly. In order to make the following description of the embodiments of the present disclosure clear and concise, the present disclosure omits detailed description of known functions and known components.

A driving circuit of a display panel mainly includes a scan driving circuit (i.e., a gate driving circuit) that drives row lines and a data driving circuit (i.e., a source driving circuit) that drives column lines. The scan driving circuit determines whether thin film transistors (TFTs) in respective pixel units of each row are turned on or off, by controlling scanning voltages of gate terminals of TFTs of each row; and the data driving circuit controls a driving voltage of a source terminal of each TFT through a Digital to Analog Converter (DAC) and the like, so as to control a data signal written into each pixel unit.

Figure 1A:
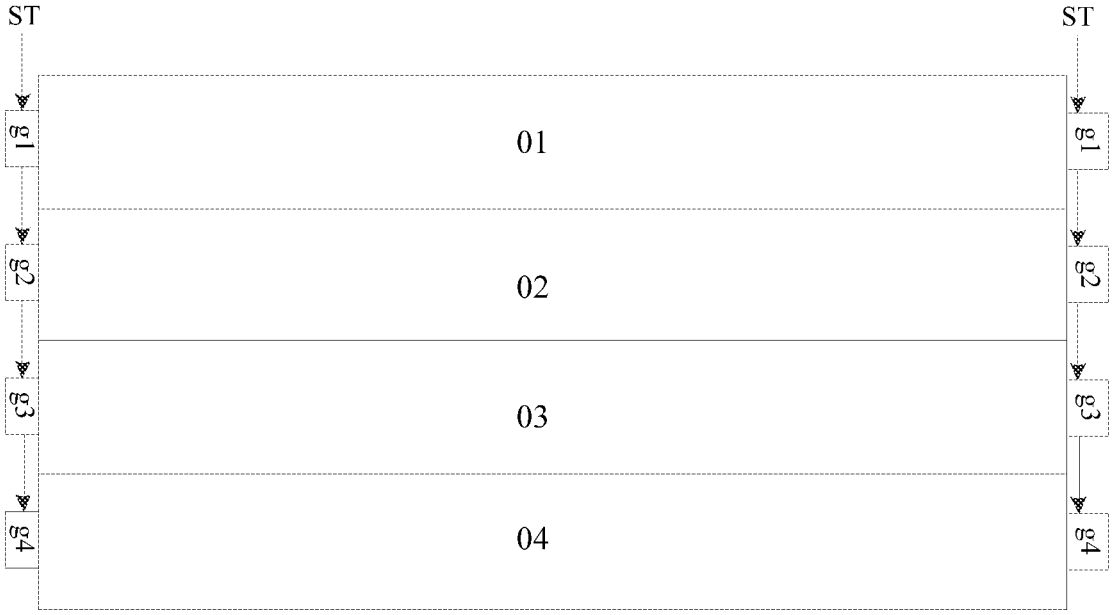
FIG. 1A is a plan schematic diagram of a display panel.
Figure 1B:
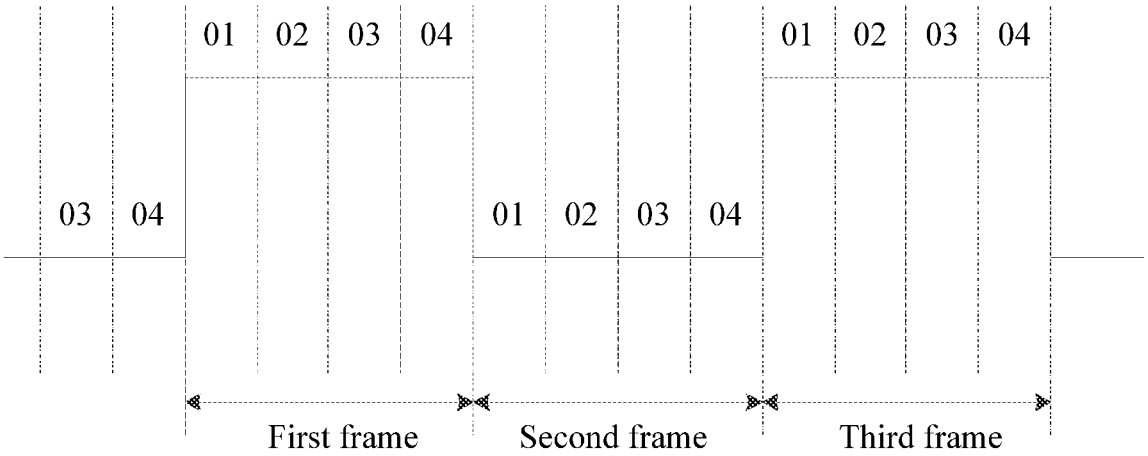
FIG. 1B is a schematic diagram of a scanning mode of the display panel shown in FIG. 1A.

For example, the scan driving circuit of the display panel may include a plurality of gate drivers, and each gate driver performs scan operations on different scanning regions, respectively. For example, as shown in FIG. 1A, the gate driver may include a first gate driver g1, a second gate driver g2, a third gate driver g3 and a fourth gate driver g4. The first gate driver g1 is configured to scan respective pixel units within a first scanning region 01, the second gate driver g2 is configured to scan respective pixel units within a second scanning region 02, the third gate driver g3 is configured to scan respective pixel units within a third scanning region 03, and the fourth gate driver g4 is configured to scan respective pixel units within a fourth scanning region 04. For example, as shown in FIG. 1A and FIG. 1B, a gate enable signal ST is transmitted to the first gate driver g1, so that the first gate driver g1 starts to perform a scan operation, and after the respective pixel units within the first scanning region 01 are all scanned, the first gate driver g1 may output a chip select signal, and the chip select signal is transmitted to the second gate driver g2, so that the second gate driver g2 starts to perform a scan operation, and so on. Therefore, within scanning time of one frame, a scanning mode of the scan driving circuit is sequentially performed from the first scanning region 01 to the fourth scanning region 04.

For example, as shown in FIG. 1B, after scanning time of a first frame is ended, that is, when the fourth gate driver g4 in FIG. 1A completes the scan operation, the scan driving circuit re-controls the first gate driver g1 through the gate enable signal ST, to start a scan operation of a next frame. That is, within scanning time of a second frame, a scanning mode of the scan driving circuit is also sequentially performed from the first scanning region 01 to the fourth scanning region 04. Similarly, within scanning time of a third frame, a scanning mode of the scan driving circuit is also sequentially performed from the first scanning region 01 to the fourth scanning region 04.

Thus, it can be known that, within the scanning time of one frame, the scan driving circuit sequentially performs scan operations from the first scanning region 01 to the fourth scanning region 04. That is, the scanning mode of the scan driving circuit is co-directional sequential scanning, which may be, for example, progressive scanning or interlaced scanning, and the like.

Figure 1C:
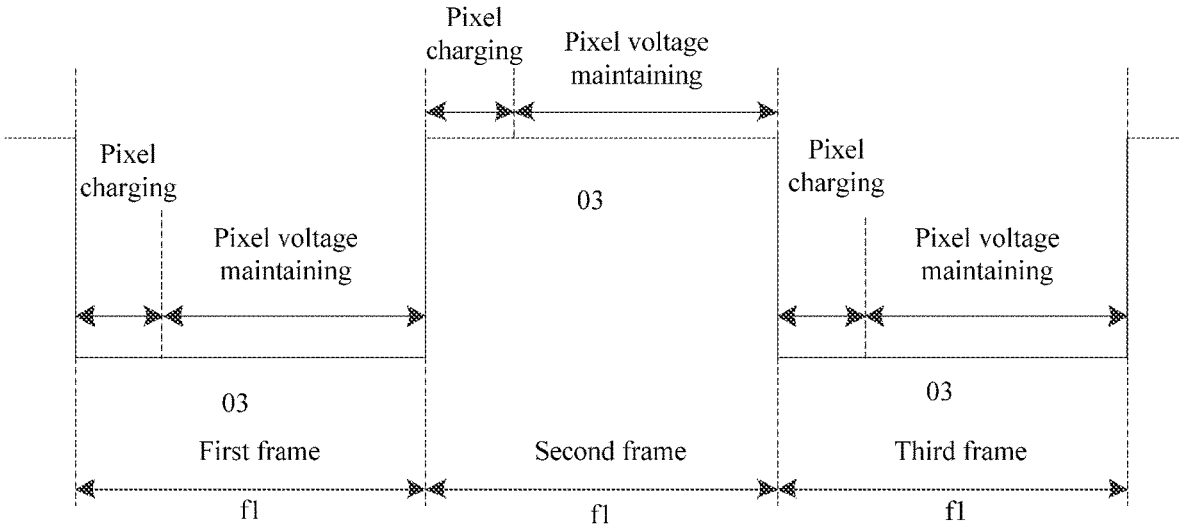
FIG. 1C is a schematic diagram of charging of a scanning region 03 shown in FIG. 1A.

For example, as shown in FIG. 1C, taking the third scanning region 03 as an example, within the scanning time of the first frame, when the third gate driver g3 performs a scan operation, the data driving circuit sequentially charges respective pixel units in the third scanning region 03, and when the first gate driver g1, the second gate driver g2 and the fourth gate driver g4 perform scan operations, the pixel units within the third scanning region 03 are always in a pixel voltage maintaining phase; within the scanning time of the second frame, when the third gate driver g3 performs a scan operation, the data driving circuit sequentially recharges respective pixel units within the third scanning region 03, repeating in this way, so as to implement picture displaying and updating. During the scanning time of each frame, the scan driving circuit can scan the respective scanning regions 01 to 04 by the same scan order, and therefore, during a scanning process, refresh frequencies of the pixel units within the third scanning region 03 are the same during the scanning time of respective frames, for example, all are f1. Likewise, for the first scanning region 01, the second scanning region 02 and the fourth scanning region 04, during the scanning process, refresh frequencies of the pixel units are also the same during the scanning time of respective frames.

For example, it is assumed that, with respect to the first scanning region 01, the second scanning region 02 and the fourth scanning region 04, in the third scanning region 03, a variation difference between display pictures of a first frame and a second frame is relatively large. Because a refresh frequency of the third scanning region 03 remains unchanged, a picture refresh speed of the third scanning region 03 may not keep up with a real-time picture change speed. Thus, phenomena such as picture jam or smear are apt to occur at the third scanning region 03, which reduces a display quality.

At least one embodiment of the present disclosure provides a scan driving circuit and a driving method thereof, and a display device, which may adjust a scan order and/or a scanning direction of respective scanning circuits in real time, dynamically increase a refresh frequency of a display image of a corresponding display region without changing an overall scanning frequency of a display panel, increase a response speed of the display image, and improve a display quality of the display image.

Several embodiments of the present disclosure are described in details below, but the present disclosure is not limited to these specific embodiments.

Figure 2:
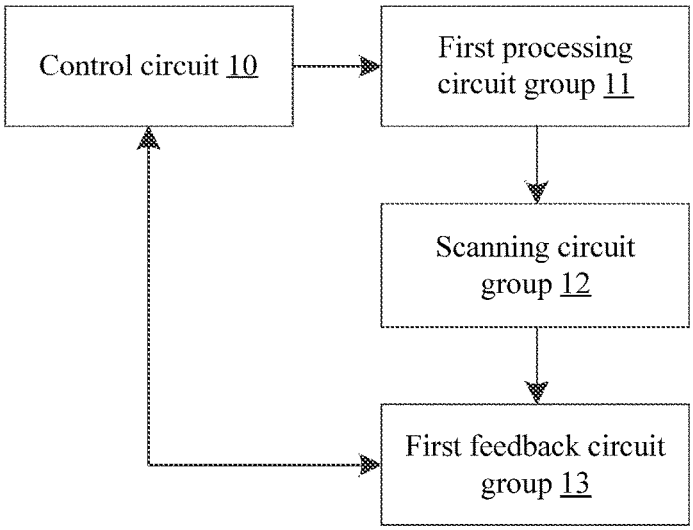
FIG. 2 is a schematic block diagram of a scan driving circuit provided by an embodiment of the present disclosure.
Figure 3:
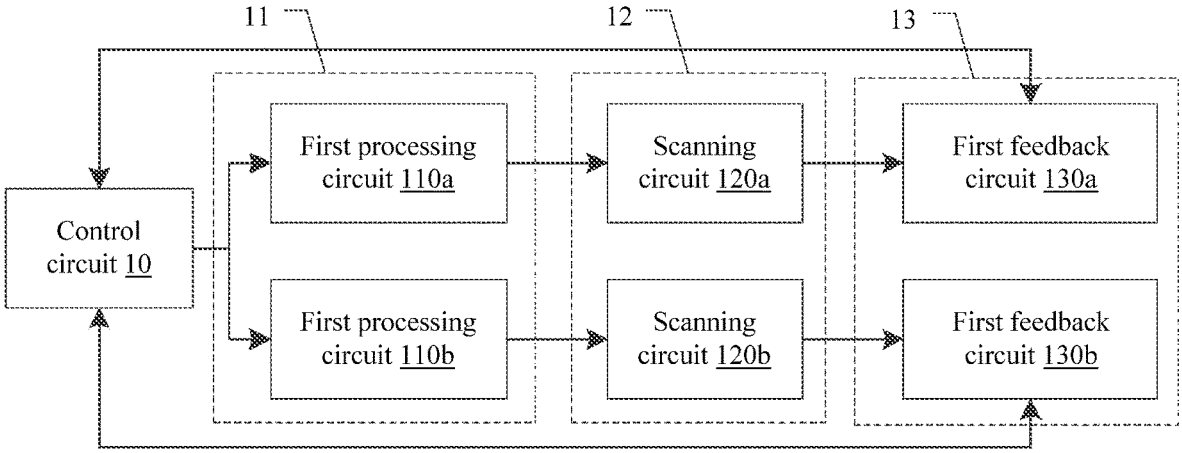
FIG. 3 is another schematic block diagram of the scan driving circuit provided by an embodiment of the present disclosure.

An embodiment of the present disclosure provides a scan driving circuit. FIG. 2 is a schematic block diagram of a scan driving circuit provided by an embodiment of the present disclosure; FIG. 3 is another schematic block diagram of the scan driving circuit provided by an embodiment of the present disclosure.

For example, as shown in FIG. 2, the scan driving circuit comprises a control circuit 10, a scanning circuit group 12 and a first processing circuit group 11. The control circuit 10 is configured to generate and output a keyword signal to the first processing circuit group 11, to control a scan order of respective scanning circuits in the scanning circuit group 12; the first processing circuit group 11 is configured to generate a scan enable signal according to the keyword signal, and output the scan enable signal to a scanning circuit corresponding to the keyword signal in the scanning circuit group 12, so as to drive the corresponding scanning circuit to perform a scan operation. The scan driving circuit provided by the embodiment of the present disclosure may be applied to, for example, various types of display panels, for example, a GOA type display panel, a COG type display panel, a COF type display panel, and the like.

For example, as shown in FIG. 3, the scanning circuit group 12 includes a plurality of scanning circuits 120 (for example, a scanning circuit 120*a* and a scanning circuit 120*b* as shown in FIG. 3). The first processing circuit group 11 includes a plurality of first processing circuits 110 (for example, a first processing circuit 110*a* and a first processing circuit 110*b* as shown in FIG. 3). The plurality of first processing circuits 110 are electrically connected with the plurality of scanning circuits 120 in one-to-one correspondence. The control circuit 10 is electrically connected with respective first processing circuits 110 (for example, the first processing circuit 110*a* and the first processing circuit 110*b*) respectively, and outputs the keyword signal to the respective first processing circuits 110.

For example, the keyword signal may be used for identifying a selected scanning circuit 120, that is to say, the selected scanning circuit 120 is a scanning circuit 120 in the scanning circuit group 12 that corresponds to the keyword signal. The control circuit 10 may generate and output a plurality of keyword signals, the number of the plurality of keyword signals may be the same as the number of the plurality of scanning circuits 120, and the plurality of keyword signals may be in one-to-one correspondence with the plurality of scanning circuits 120. An output order of the plurality of keyword signals may determine a scan order of the plurality of scanning circuits 120. For example, a first processing circuit 110 electrically connected with the selected scanning circuit 120 may be referred to as a selected first processing circuit 110. When the keyword signal is input to the selected first processing circuit 110, the selected first processing circuit 110 generates a scan enable signal, and outputs the scan enable signal to the selected scanning circuit 120, so as to drive the selected scanning circuit 120 to start a scan operation. When the keyword signal is input to an unselected first processing circuit 110, the unselected first processing circuit 110 does not generate a scan enable signal, and thus, a scanning circuit 120 electrically connected with the unselected first processing circuit 110 does not perform a scan operation. Therefore, the control circuit 10 may determine the scan order of respective scanning circuits 120 in the scanning circuit group 12, by controlling the output order of the keyword signals corresponding to the respective scanning circuits 120.

For example, as shown in FIG. 2 and FIG. 3, the scan driving circuit further comprises a first feedback circuit group 13. The first feedback circuit group 13 includes a plurality of first feedback circuits 130 (for example, a first feedback circuit 130*a* and a first feedback circuit 130*b* as shown in FIG. 3) that are in one-to-one correspondence with the plurality of scanning circuits 120. For example, the respective first feedback circuits 130 are all electrically connected with the control circuit 10, to receive the keyword signals transmitted from the control circuit 10 and transmit keyword feedback signals to the control circuit 10. The respective first feedback circuits 130 are also electrically connected with the respective scanning circuits 120 in one-to-one correspondence. When the selected scanning circuit 120 completes the scan operation, the selected scanning circuit 120 is further configured to output a scan completion signal to a corresponding first feedback circuit 130. The corresponding first feedback circuit 130 is configured to generate a keyword feedback signal in response to the scan completion signal and the keyword signal, and then output the keyword feedback signal to the control circuit 10.

It should be noted that, in order to clearly show connection relationship of respective portions of the scan driving circuit, FIG. 3 only exemplarily show two first processing circuits 110, two scanning circuits 120 and two first feedback circuits 130. However, the embodiment of the present disclosure is not limited thereto, for example, according to actual needs, the scan driving circuit may comprise one or more first processing circuits 110, one or more scanning circuits 120, and one or more first feedback circuits 130; the respective first processing circuits 110 are electrically connected with the respective scanning circuits 120 in one-to-one correspondence, and the respective first feedback circuits 130 are also electrically connected with the respective scanning circuits 120 in one-to-one correspondence. The amount of first processing circuits 110, the amount of scanning circuits 120 and the amount of first feedback circuits 130 will not be limited in the embodiment of the present disclosure.

For example, the control circuit 10 may be implemented by adopting a hardware circuit; for example, the control circuit 10 may be composed by transistors, encoders, decoders, amplifiers, and other elements. For another example, the control circuit 10 may also be implemented by a signal processor such as an FPGA, a DSP and a CMU. The control circuit 10 may include, for example, a processor and a memory, and the processor executes a software program stored in the memory to implement functions such as generating and outputting different keyword signals based on a scan order.

For example, the first processing circuit 110, the first feedback circuit 130 and the scanning circuit 120 may also be implemented by adopting the hardware circuit. Specific circuit structures of the first processing circuit 11, the first feedback circuit 130 and the scanning circuit 120 may be designed according to actual application needs, which will not be specifically limited in the embodiment of the present disclosure.

Figure 4:
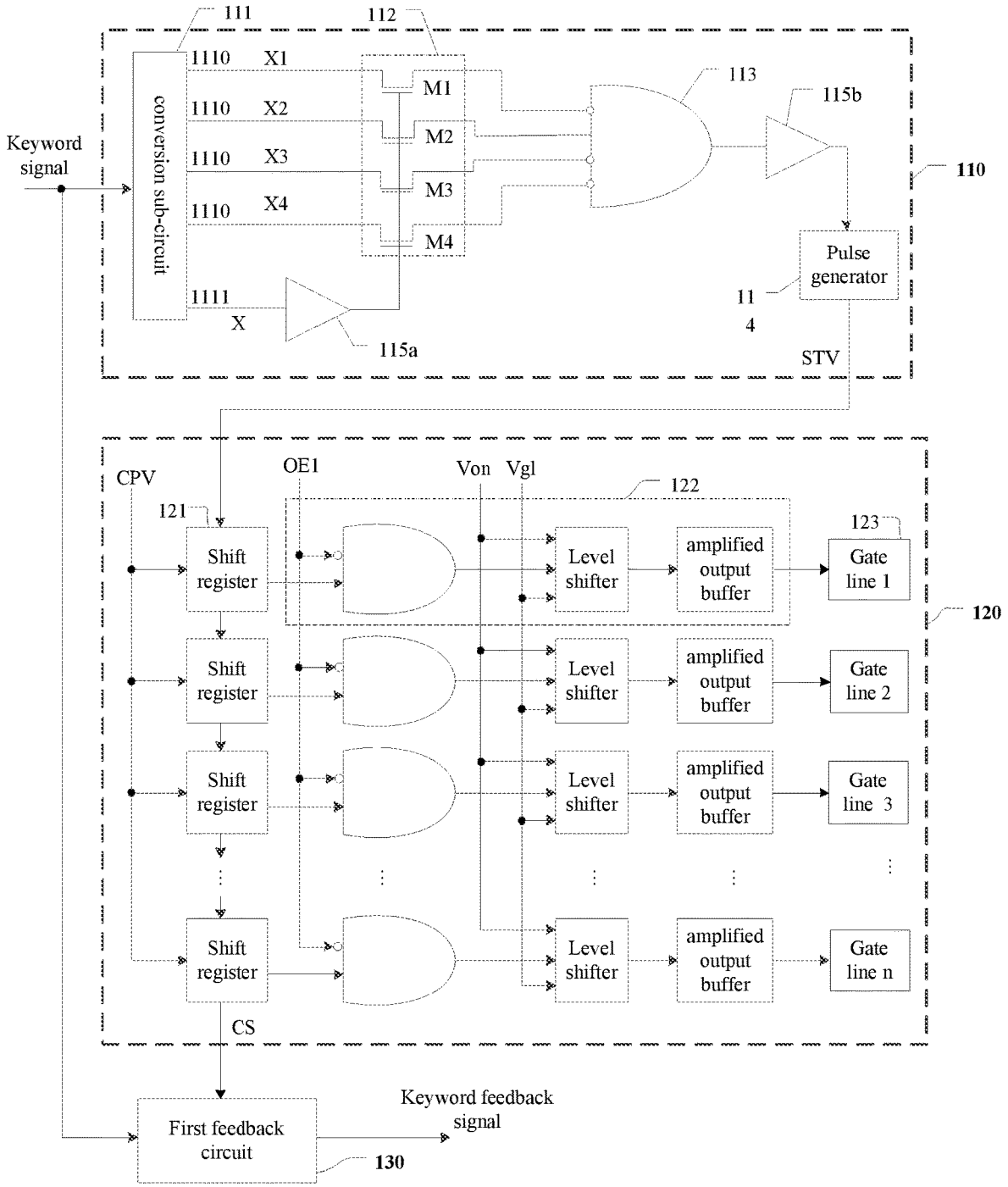
FIG. 4 is a structural schematic diagram of a first processing circuit and a scanning circuit in the scan driving circuit provided by an embodiment of the present disclosure.
Figure 5:
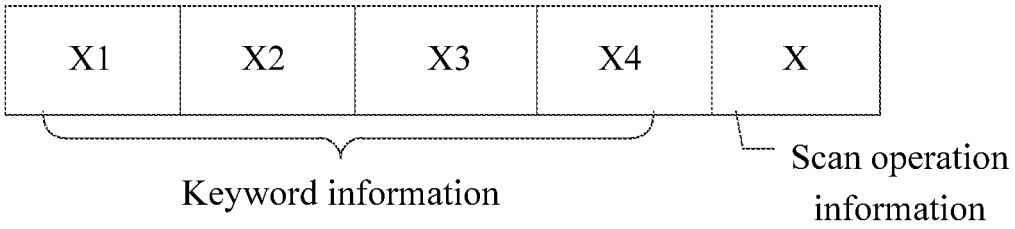
FIG. 5 is a schematic diagram of a keyword signal provided by an embodiment of the present disclosure.
Figure 6:
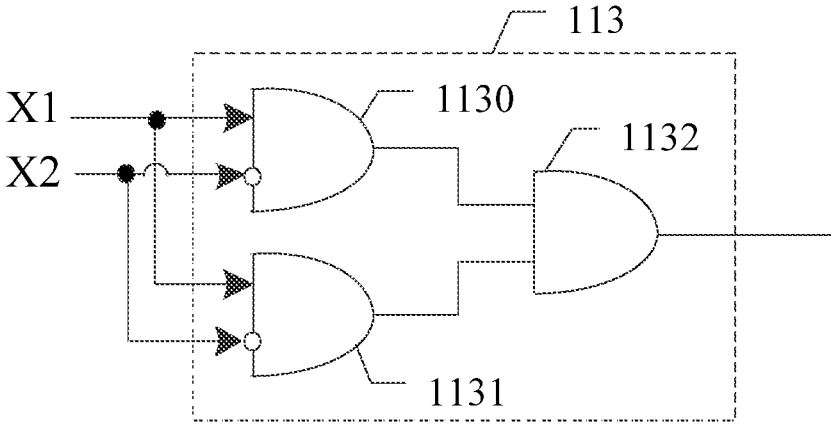
FIG. 6 is a structural schematic diagram of a judgment sub-circuit provided by an embodiment of the present disclosure.

FIG. 4 is a structural schematic diagram of a first processing circuit and a scanning circuit in the scan driving circuit provided by an embodiment of the present disclosure; FIG. 5 is a schematic diagram of a keyword signal provided by an embodiment of the present disclosure; FIG. 6 is a structural schematic diagram of a judgment sub-circuit provided by an embodiment of the present disclosure.

For example, as shown in FIG. 4, in a first example, each of the first processing circuits 110 includes a conversion sub-circuit 111, a switch sub-circuit 112, a judgment sub-circuit 113 and an output sub-circuit 114.

For example, the conversion sub-circuit 111 is configured to receive the keyword signal, and convert series information in the keyword signal into parallel information. The parallel information may be a multi-bit binary number, and includes keyword information and scan operation information. The keyword information is configured to identify the selected scanning circuit 120, and the scan operation information is configured to determine whether or not the selected scanning circuit 120 completes the scan operation.

For example, as shown in FIG. 5, when the scanning circuit group 12 includes four scanning circuits 120 (for example, in a case that the display panel is divided into four display regions that are in one-to-one correspondence with the four scanning circuits 120), the keyword information includes four binary numbers X1, X2, X3 and X4 arranged sequentially, and the scan operation information includes a binary number X. For example, when X=1, it indicates that the selected scanning circuit 120 starts the scan operation; when X=0, it indicates that the selected scanning circuit 120 completes the scan operation. The conversion sub-circuit 111 is further configured to output the keyword information and the scan operation information to the switch sub-circuit 112.

For example, the amount of bits of the binary number in the keyword information is equal to the amount of scanning circuits 120.

For example, when the scan operation information indicates that the scan operation is started, the switch sub-circuit 112 is turned on and outputs the keyword information to the judgment sub-circuit 113, and the judgment sub-circuit 113 generates a judgment result according to the keyword information and outputs the judgment result to the output sub-circuit 114. When the corresponding scanning circuit 120 is selected to perform the scan operation, the judgment result is a turn-on signal; and when the corresponding scanning circuit 120 is not selected, the judgment result is a turn-off signal. When the judgment result is the turn-on signal, the output sub-circuit 114 may output the scan enable signal STV to the selected scanning circuit 120.

For example, when the judgment result is the turn-on signal, a logical value of the judgment result may be 1; and when the judgment result is the turn-off signal, the logical value of the judgment result may be 0. A specific numerical value of the judgment result will not be limited in the present disclosure here.

For example, the conversion sub-circuit 111 may include a plurality of keyword output terminals 1110 and a scan operation output terminal 1111, and the amount of the plurality of keyword output terminals 1110 may be equal to the amount of bits of the keyword information, so that the plurality of keyword output terminals 1110 may respectively output different bits of the keyword information. As shown in FIG. 4, in a case where the keyword information comprises four binary numbers X1, X2, X3 and X4, the conversion sub-circuit 111 may include four keyword output terminals 1110, so as to respectively output X1, X2, X3 and X4.

For example, the judgment sub-circuit 113 may include an AND gate. As shown in FIG. 4, the judgment sub-circuit 113 may include an AND gate, and the amount of input terminals of the AND gate is equal to the amount of bits of the keyword information. It is assumed that the keyword information for selecting the first processing circuit 110 and the scanning circuit 120 shown in FIG. 4 is 0100, and the four input terminals of the judgment sub-circuit 113 respectively corresponding to the keyword information X1, X2, X3 and X4 may be set to be negative, positive, negative and negative. At this time, when the keyword information is 0100, that is, X1=0, X2=1, X3=0, and X4=0, the logical value of the judgment result of the judgment sub-circuit 113 is 1, that is, the judgment result is the turn-on signal. That is to say, when the keyword information is 0100, the first processing circuit 110 shown in FIG. 4 is selected, and can output the scan enable signal STV. If the keyword information is other information except 0100, the logical value of the judgment result of the judgment sub-circuit 113 shown in FIG. 4 is 0, that is, the judgment result is the turn-off signal.

It should be noted that, in FIG. 4, settings of respective input terminals of the AND gate in the first processing circuit 110 are in one-to-one correspondence with respective bits of the keyword information that can select the first processing circuit 110. For example, a keyword information bit with a logical value of "1" corresponds to a "positive" input terminal, and a keyword information bit with a logical value of "0" corresponds to a "negative" input terminal. Certainly, the respective input terminals of the AND gate in the first processing circuit 110 may also be set in other modes, which will not be limited in the present disclosure here.

For example, as shown in FIG. 4, the switch sub-circuit 112 includes a plurality of switch transistors, and the amount of the plurality of switch transistors is equal to the amount of bits of the keyword information. For example, when the keyword information comprises four binary numbers X1, X2, X3 and X4, the switch sub-circuit 112 includes a first switch transistor M1, a second switch transistor. M2, a third switch transistor M3 and a fourth switch transistor M4. A gate electrode of each switch transistor is electrically connected with a scan operation output terminal 1111 of the conversion sub-circuit 111, to receive the scan operation information (for example, X); a first electrode of each switch transistor is electrically connected with a corresponding keyword output terminal 1110 of the conversion sub-circuit 111, to receive one bit of the keyword information (e.g., X1, X2, X3 and X4); and a second electrode of each switch transistor is electrically connected with a corresponding input terminal of the judgment sub-circuit 113.

It is to be noted that, transistors used in the embodiments of the present disclosure may be thin film transistors, field effect transistors or other switch devices with the like characteristics. A source electrode and a drain electrode of the transistor used herein may be symmetrical in structure, so the source electrode and the drain electrode of the transistor may have no difference in structure. In the embodiments of the present disclosure, in order to distinguish two electrodes of the transistor apart from a gate electrode, one of the two electrodes is directly referred to as a first electrode, and the other of the two electrodes is referred to as a second electrode, and therefore the first electrode and the second electrode of all or part of the transistors in the embodiments of the present disclosure are interchangeable as required. For example, the first electrode of the transistor described in the embodiment of the present disclosure may be the source electrode, and the second electrode of the transistor may be the drain electrode; alternatively, the first electrode of the transistor may be the drain electrode, and the second electrode of the transistor may be the source electrode. In addition, the transistors may be classified into N-type transistors and P-type transistors according to the characteristics of the transistors, and the embodiments of the present disclosure are described in detail by taking the switch transistors as the N-type transistors as an example. Based on the description and teachings of the implementations of the N-type transistors in the present disclosure, a person having ordinary skill in the art can implement the embodiments of the present disclosure by using P-type transistors, without any inventive work, which should be within the scope of the disclosure.

For example, the output sub-circuit 114 includes a pulse generator, for example, the pulse generator may convert a narrow pulse signal into a broad pulse signal. An output terminal of the judgment sub-circuit 113 is electrically connected with the output sub-circuit 114. When the judgment result of the judgment sub-circuit 113 is the turn-on signal, the turn-on signal is the narrow pulse signal, which cannot be used for driving the scanning circuit 120 to perform a scan operation, and the turn-on signal with the narrow pulse needs to be converted by the pulse generator into a scan enable signal STV with the broad pulse which may drive the scanning circuit 120 to perform the scan operation, and then the scan enable signal STV is output to the selected scanning circuit 120, to drive the selected scanning circuit 120 to start the scan operation.

For example, each of the first processing circuits 110 further includes a first amplifier 115*a* and a second amplifier 115*b*. An input terminal of the first amplifier 115*a* is electrically connected with the scan operation output terminal 1111, and an output terminal of the first amplifier 115*a* is electrically connected with a gate electrode of each switch transistor. An input terminal of the second amplifier 115*b* is electrically connected with the output terminal of the judgment sub-circuit 113, and an output terminal of the second amplifier 115*b* is electrically connected with the input terminal of the output sub-circuit 114. The first amplifier 115*a* is used for amplifying the scan operation information, so that a voltage of the scan operation information satisfies a turn-on voltage of the switch transistor. The second amplifier 115*b* is used for amplifying the turn-on signal output by the judgment sub-circuit 113.

It should be noted that, in this embodiment, the logical value "0" may represent a low level, and the logical value "1" may represent a high level. The input terminal of the AND gate is set to "negative", which indicates that: when the logical value of input information is 1, the logical value of the judgment result is 0; and when the logical value of the input information is 0, the logical value of the judgment result is 1. The input terminal of the AND gate is set to "positive", which indicates that: when the logical value of the input information is 1, the logical value of the judgment result is 1; and when the logical value of the input information is 0, the logical value of the judgment result is 0. The present disclosure may further include other setting modes, and the present disclosure is not limited thereto.

For example, the scanning circuit 120 is configured to generate scanning signals, to sequentially turn on thin film transistors in respective rows. As shown in FIG. 4, in one example, each of the scanning circuits 120 includes a plurality of shift registers 121, a plurality of scan output sub-circuits 122 and a plurality of gate lines 123. The plurality of shift registers 121 are electrically connected with the plurality of scan output sub-circuits 122 in one-to-one correspondence, and the plurality of scan output sub-circuits 122 are electrically connected with the plurality of gate lines 123 in one-to-one correspondence. For example, each shift register 121 may include a D trigger, and the like; each scan output sub-circuit 122 includes an AND gate, a level shifter, amplified output buffer, and the like.

For example, the shift register 121 and the scan outputting sub-circuit 122, under control of the scan enable signal STV, scan output control information OE1 and scan shift signal CPV, apply a high voltage Von and a low voltage Vgl to the gate line 123 in a time sharing manner, so as to control corresponding thin film transistors in the display panel to be turned on or turned off.

For example, when the scan enable signal STV is effective (for example, when the scan enable signal STV is at a high level), at a rising edge of the scan shift signal CPV, the shift register 121 may generate and output a low voltage logical value, and the low voltage logical value is, for example, 5V/0V. When the scan output control information OE1 is effective (for example, when the scan output control information OE1 is at a low level), the AND gate may transmit the low voltage logical value output by the shift register 121 to the level shifter. The level shifter uses the low voltage logical value to implement outputting a high voltage logical value, the high voltage logical value may be an operating voltage value required to drive the pixel unit to operate, and the high voltage logical value include the high voltage Von (e.g., 40V) and the low voltage Vgl (e.g., 0V). Because a load capacitance formed by the thin film transistor, a data line, the pixel unit, and the like is relatively large, if the high voltage logical value output by the level shifter directly drives the pixel unit through the gate line 123, a drive capability of the high voltage logical value may be insufficient, and thus, the amplified output buffer needs to be disposed between the gate line 123 and the level shifter, so as to increase an output drive capability of the scan outputting sub-circuit 122.

For example, after the selected scanning circuit 120 completes the scan operation, the selected scanning circuit 120 may output a scan completion signal CS to a corresponding first feedback circuit 130. The corresponding first feedback circuit 130 generates a keyword feedback signal in response to the scan completion signal CS and the keyword signal, and then outputs the keyword feedback signal to the control circuit 10. For example, the corresponding first feedback circuit 130 may perform an operation of subtracting one on the scan operation information in the keyword signal in response to the scan completion signal CS, to obtain the keyword feedback signal. For example, the keyword feedback signal indicates that the selected scanning circuit 120 completes the scan operation.

For example, the first feedback circuit 130 may be implemented by adopting transistors, AND gates, JK triggers, T triggers, amplifiers and/or other suitable hardware, and the present disclosure is not limited thereto.

Figure 7A:
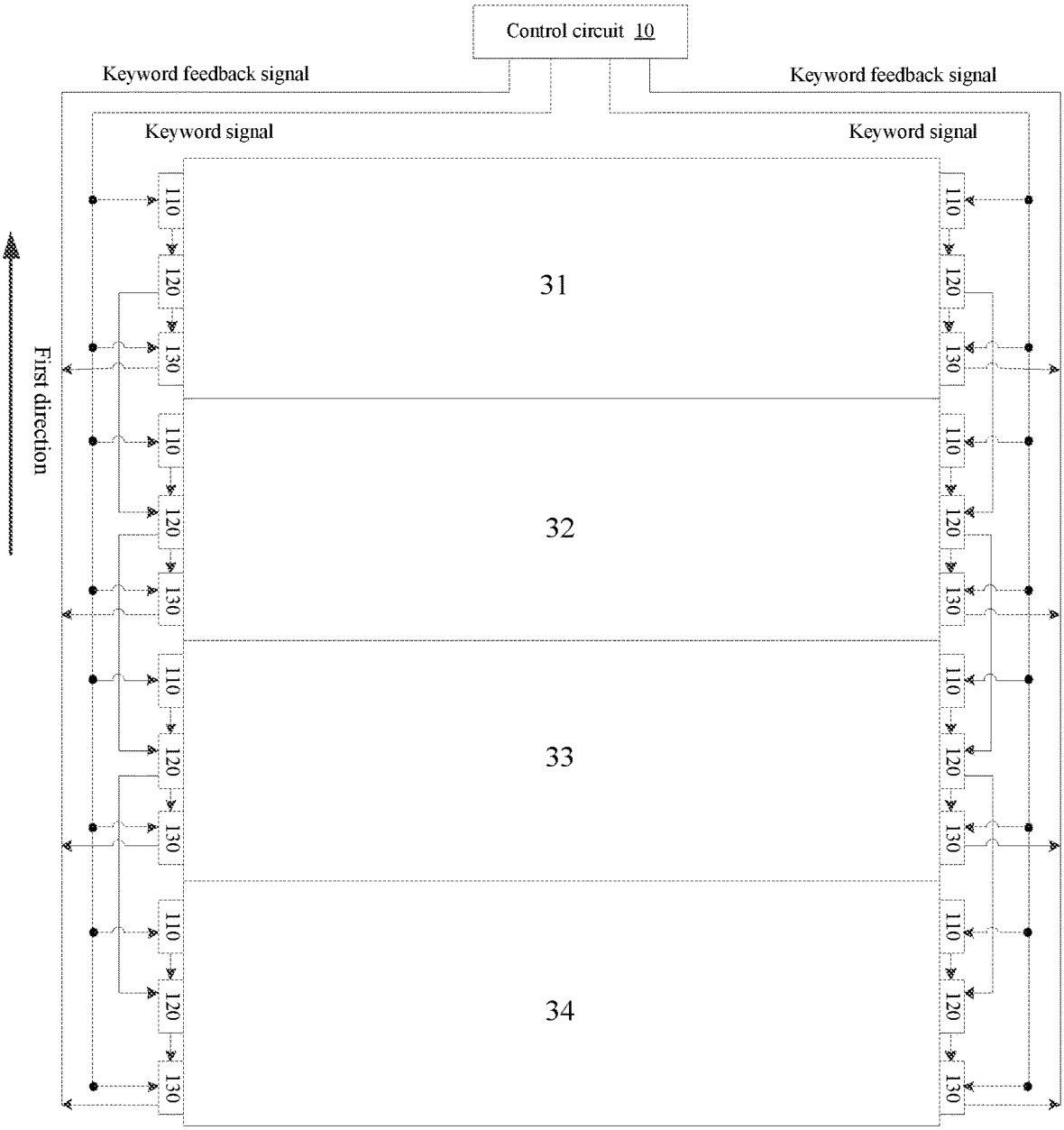
FIG. 7A is a plan schematic diagram of a display panel provided by an embodiment of the present disclosure.
Figure 7B:
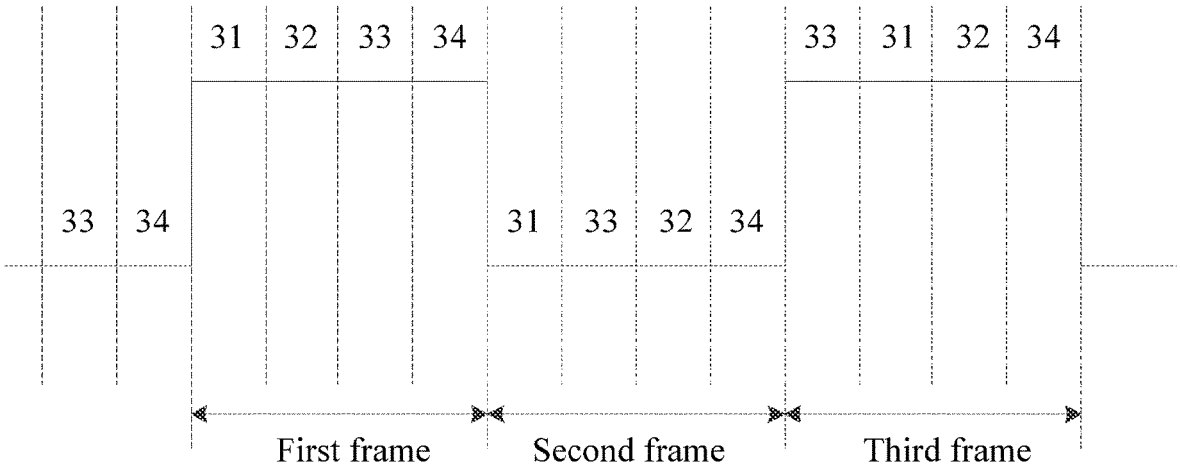
FIG. 7B is a schematic diagram of a scanning mode of the display panel provided by an embodiment of the present disclosure.
Figure 7C:
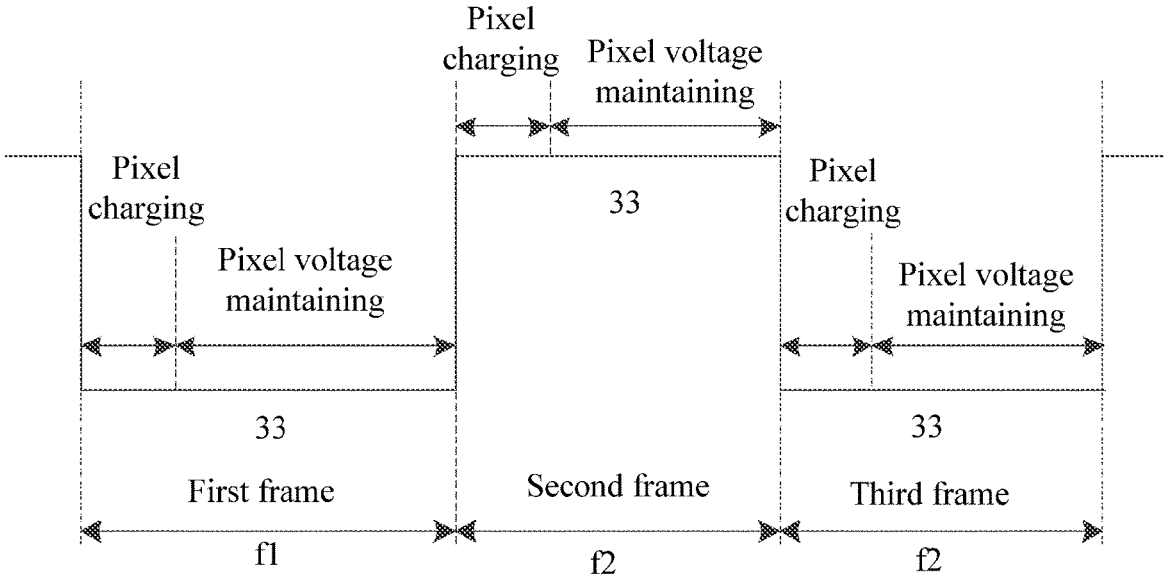
FIG. 7C is a schematic diagram of charging of a display region 33 shown in FIG. 7B.

FIG. 7A is a plan schematic diagram of a display panel provided by an embodiment of the present disclosure, FIG. 7B is a schematic diagram of a scanning mode of the display panel provided by an embodiment of the present disclosure, and FIG. 7C is a schematic diagram of charging of a display region 33 shown in FIG. 7B.

For example, according to the amount of the scanning circuits 120 and/or the amount of the first processing circuits 110, the display panel may be divided into a plurality of different display regions, and the plurality of scanning circuits 120 and/or the plurality of first processing circuits 110 may be in one-to-one correspondence with the plurality of display regions respectively. As shown in FIG. 7A, the display panel may be divided, along a first direction, into a first display region 31, a second display region 32, a third display region 33 and a fourth display region 34. For example, shapes and areas of the first display region 31, the second display region 32, the third display region 33 and the fourth display region 34 may be the same or different. It should be noted that, the display panel may be divided into any number of display regions, and each display region corresponds to a scanning circuit 120 and/or a first processing circuit 110, which will not be limited in the embodiment of the present disclosure here.

For example, in the example shown in FIG. 7A, the scan driving circuit may further implement co-directional sequential scanning. As shown in FIG. 7A, respective scanning circuits 120 may be electrically connected with each other; and after the scanning circuit 120 completes the scan operation, the scanning circuit 120 transmits the scan completion signal to a next scanning circuit 120 adjacent thereto, to drive the next scanning circuit 120 to perform a scan operation, so as to implement the co-directional sequential scanning.

It should be noted that, in FIG. 7A, each display region may be provided with first processing circuits 110, scanning circuits 120 and first feedback circuits 130 on both sides thereof, so that bilateral scan driving may be implemented. However, the present disclosure is not limited thereto; each display region may further be provided with a first processing circuit 110, a scanning circuit 120 and a first feedback circuit 130 on only one side thereof, so as to implement unilateral scanning. For example, the corresponding first processing circuits 110, scanning circuits 120, and first feedback circuits 130 may be integrated in one chip.

For example, in conjunction with FIG. 5 and FIG. 7A, with respect to a scanning circuit group 12 having four scanning circuits 120 (the display panel is divided into four display regions), the keyword information and the scan operation information are sequentially arranged in parallel as a five-bit binary number. When the keyword information is 1000, that is, X1=1, X2=0, X3=0, and X4=0, it indicates that the scanning circuit 120 corresponding to the first display region 31 is selected to perform a scan operation; when the keyword information is 0100, that is, when X1=0, X2=1, X3=0, and X4=0, it indicates that the scanning circuit 120 corresponding to the second display region 32 is selected to perform a scan operation; when the keyword information is 0010, that is, when X1=0, X2=0, X3=1, and X4=0, it indicates that the scanning circuit 120 corresponding to the third display region 33 is selected to perform a scan operation; and when the keyword information is 0001, that is, when X1=0, X2=0, X3=0, and X4=1, it indicates that the scanning circuit 120 corresponding to the fourth display region 34 is selected to perform a scan operation.

For example, the judgment sub-circuits 113 of the first processing circuits 110 corresponding to the plurality of display regions are all AND gates, each of which has four input terminals; however, settings of the input terminals of the AND gates corresponding to different display regions are different from one another. For example, in correspondence between the keyword information and the display region as described above, for the judgment sub-circuit 113 corresponding to the first display region 31 (the selected keyword information is 1000), settings of four input terminals corresponding to the keyword information X1, X2, X3 and X4 are respectively positive, negative, negative and negative; for the judgment sub-circuit 113 corresponding to the second display region 32 (the selected keyword information is 0100), settings of four input terminals corresponding to the keyword information X1, X2, X3 and X4 are respectively negative, positive, negative and negative; for the judgment sub-circuit 113 corresponding to the third display region 33 (the selected keyword information is 0010), settings of four input terminals corresponding to the keyword information X1, X2, X3 and X4 are respectively negative, negative, positive and negative; and for the judgment sub-circuit 113 corresponding to the fourth display region 34 (the selected keyword information is 0001), settings of four input terminals corresponding to the keyword information X1, X2, X3 and X4 are respectively negative, negative, negative and positive.

For example, the keyword signal may be simultaneously output to all of the first processing circuits 110; however, because settings of input terminals of the judgment sub-circuits 113 of respective first processing circuits 110 are different from one another, only the first processing circuit 110 corresponding to the keyword signal may be selected and output the scan enable signal.

It should be noted that, correspondence between the keyword information and the display region is not limited to the above description; according to actual application requirements and circuit design, other correspondences may also be adopted, and only the setting of the input terminals of the judgment sub-circuit 113 may be changed accordingly. For example, when the keyword information is 0111, that is, X1=0, X2=1, X3=1, and X4=1, it indicates that the scanning circuit 120 corresponding to the first display region 31 is selected to perform a scan operation, and settings of four input terminals corresponding to the keyword information X1, X2, X3 and X4 in a corresponding AND gate 113 are respectively negative, positive, positive and positive; when the keyword information is 1011, that is, X1=1, X2=0, X3=1, and X4=1, it indicates that the scanning circuit 120 corresponding to the second display region 32 is selected to perform a scan operation, and settings of four input terminals corresponding to the keyword information X1, X2, X3 and X4 in a corresponding AND gate 113 are respectively positive, negative, positive and positive; when the keyword information is 1101, that is, X1=1, X2=1, X3=0 and X4=1, it indicates that the scanning circuit 120 corresponding to the third display region 33 is selected to perform a scan operation, and settings of four input terminals corresponding to the keyword information X1, X2, X3 and X4 in a corresponding AND gate 113 are respectively positive, positive, negative and positive; when the keyword information is 1110, that is, X1=1, X2=1, X3=1 and X4=0, it indicates that the scanning circuit 120 corresponding to the fourth display region 34 is selected to perform a scan operation, and settings of four input terminals corresponding to the keyword information X1, X2, X3 and X4 in a corresponding AND gate 113 are respectively positive, positive, positive and negative. For example, a keyword information bit with a logical value of "1" corresponds to a "positive" input terminal, and a keyword information bit with a logical value of "0" corresponds to a "negative" input terminal. In this case, the setting of the input terminals of the judgment sub-circuit 113 is opposite to the setting in the above description. Correspondence between the keyword information and the display region will not be specifically limited in this embodiment.

For example, the amount of bits of the keyword information is not limited to the above description, and the keyword information may also comprise two binary numbers X1 and X2 arranged sequentially, provided that a circuit structure of the judgment sub-circuit 113 is changed accordingly. In this case, for example, when the keyword information is 00, that is, X1=0, X2=0, it indicates that the scanning circuit 120 corresponding to the first display region 31 is selected to perform a scan operation; when the keyword information is 01, that is, X1=0, X2=1, it indicates that the scanning circuit 120 corresponding to the second display region 32 is selected to perform a scan operation; when the keyword information is 10, that is, X1=1, X2=0, it indicates that the scanning circuit 120 corresponding to the third display region 33 is selected to perform a scan operation; and when the keyword information is 11, that is, X1=1, X2=1, it indicates that the scanning circuit 120 corresponding to the fourth display region 33 is selected to perform a scan operation.

For example, when the keyword information comprises two binary numbers X1 and X2, as shown in FIG. 6, the judgment sub-circuit 113 may be constituted by three AND gates. An input terminal of a first AND gate 1130 corresponding to X1 of the keyword information is set to positive and an input terminal of a second AND gate 1131 corresponding to X2 of the keyword information is set to negative; and input terminals of the third AND gate 1132 corresponding to an output terminal of the first AND gate 1130 and an output terminal of the second AND gate 1131 are respectively set to positive and positive. Therefore, the judgment sub-circuit 113 shown in FIG. 6 indicates that when the keyword information is 10, that is, X1=1, X2=0, the judgment result output is the turn-on signal (for example, the logical value 1); and when the keyword information is 00, 01 and 11, the judgment result output by the judgment sub-circuit 113 is the turn-off signal (for example, the logical value 0).

For example, the control circuit 10 is further configured to determine a scan order of the plurality of scanning circuits 120, according to a variation difference of adjacent frames in the plurality of display regions. The control circuit 10 is further configured to receive the keyword feedback signal from the first feedback circuit 130, and generate a next keyword signal according to the scan order of the plurality of scanning circuits 120 and the keyword feedback signal. For example, display pictures of adjacent frames of respective display regions may be separately perform differentiated comparison, and the respective display regions are sorted according to differentiation of the display pictures; the higher the differentiation, the higher the priority of the scan order of the corresponding display region within scanning time of one frame. The control circuit 10 may, with reference to differentiation of the display pictures and according to a designed output principle, generate and output the scan order of the plurality of scanning circuits 120, so that the scan driving circuit may dynamically adjust the scan order of the plurality of scanning circuits 120 in real time, according to a variation difference of adjacent frames, increase the refresh frequency of the display region where the variation difference of adjacent frames is relatively large, enhance a response speed of the picture, and improve a display quality of the picture.

For example, as shown in FIG. 7A to FIG. 7C, in one specific example, the scan driving circuit comprises four first processing circuits 110, four scanning circuits 120 and four first feedback circuits 130; and the display panel is divided into four display regions. It is assumed that, by comparing a variation difference of pictures in the four display regions, it is found that, with respect to the scanning time of the first frame, during the scanning time of the second frame, a variation difference of the display picture in the third display region 33 is larger than that of other display regions. Therefore, during the scanning time of the second frame, the control circuit 10 may adjust the scan order of the plurality of scanning circuits 120, and shift the scanning position of the scanning circuit 120 corresponding to the third display region 33 forward by one position (that is, a scanning circuit 120 corresponding to the third display region 33 performs the scan operation ahead of a scanning circuit 120 corresponding to the second display region 32). Taking an arrangement order of the keyword information and the scan operation information shown in FIG. 5 as an example, in this case, within the scanning time of the second frame, a scanning process of the scan driving circuit is as follows:

S1: the control circuit 10 generates and outputs a keyword signal 10001, so that a first processing circuit 110, a scanning circuit 120 and a first feedback circuit 130 corresponding to the first display region 31 are selected to perform the scan operation, and when scanning is completed, the first feedback circuit 130 corresponding to the first display region 31 generates and outputs a keyword feedback signal 10000 (10001−1=10000) to the control circuit 10;

S2: after receiving the keyword feedback signal 10000, the control circuit 10 generates and outputs a next keyword signal 00101 according to the scan order, so that a first processing circuit 110, a scanning circuit 120 and a first feedback circuit 130 corresponding to the third display region 33 are selected to perform the scan operation, and when scanning is completed, the first feedback circuit 130 corresponding to the third display region 33 generates and outputs a keyword feedback signal 00100 (00101−1=00100) to the control circuit 10;

S3: after receiving the keyword feedback signal 00100, the control circuit 10 generates and outputs a next keyword signal 01001 according to the scan order, so that a first processing circuit 110, a scanning circuit 120 and a first feedback circuit 130 corresponding to the second display region 32 are selected to perform the scan operation, and when scanning is completed, the first feedback circuit 130 corresponding to the second display region 32 generates and outputs a keyword feedback signal 01000 (01001−1=01000) to the control circuit 10;

S4: after receiving the keyword feedback signal 01000, the control circuit 10 generates and outputs a next keyword signal 00011 according to the scan order, so that a first processing circuit 110, a scanning circuit 120 and a first feedback circuit 130 corresponding to the fourth display region 34 are selected to perform the scan operation, and when scanning is completed, the first feedback circuit 130 corresponding to the fourth display region 34 generates and outputs a keyword feedback signal 00010 (00011−1=00010) to the control circuit 10.

Thus, the scan driving circuit completes scanning of a second frame. As shown in FIG. 7B, within the scanning time of the first frame, the scan order of respective display regions is that: scanning is sequentially performed from the first display region 31 to the fourth display region 34, and a pixel refresh frequency of the third display region 33 may be f1; within the scanning time of the second frame, the scan order of respective display regions becomes an order of the first display region 31, the third display region 33, the second display region 32 and the fourth display region 34, that is, the scanning position of the third display region 33 is shifted forward by one position, so that the pixel refresh frequency of the third display region 33 is increased, and may be f2, where f2 is greater than f1, and thus, a response speed of the display picture of the third display region 33 is increased.

For example, within scanning time of one frame, each of the display regions includes a pixel charging process and a pixel voltage maintaining process. As shown in FIG. 7C, taking the third display region 33 as an example, within the scanning time of the second frame, a pixel charging process of the third display region 33 is shifted forward by one bit, and pixel charging time of the third display region 33 remains unchanged, but pixel voltage maintaining time is decreased, so that the pixel refresh frequency of the third display region 33 is increased.

For example, relative to the scanning time of the second frame, if within the scanning time of a third frame, a variation difference of the display picture of the third display region 33 is still larger than that of other display regions, then the scanning position of the third display region 33 may still be shifted forward by one position, so that during the scanning time of the third frame, the scan order of the display panel becomes an order of the third display region 33, the first display region 31, the second display region 32 and the fourth display region 34, and the pixel refresh frequency of the third display region 33 may still be f2.

It should be noted that, the scan order is adjusted with reference to the scan order of respective display regions in the scanning time of an adjacent previous frame. As shown in FIG. 7B, during both the scanning time of the second frame and the scanning time of the third frame, the scanning position of the third display region 33 is only shifted forward by one position, so that the pixel refresh frequency of the third display region 33 within the scanning time of the second frame and the pixel refresh frequency of the third display region 33 within the scanning time of the third frame are the same, both being f2. According to actual needs, the scanning position of the third display region 33 may be shifted forward by a plurality of positions (for example, shifted forward by two positions), which will not be specifically limited.

Figure 8:
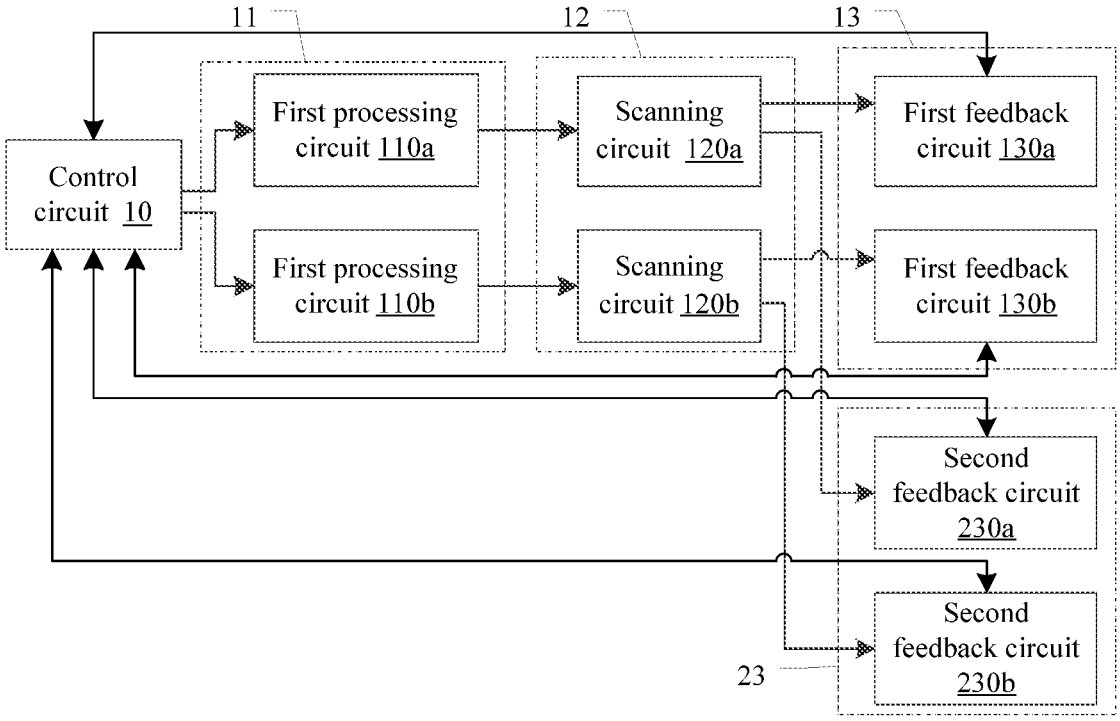
FIG. 8 is a schematic block diagram of another scan driving circuit provided by an embodiment of the present disclosure.
Figure 9:
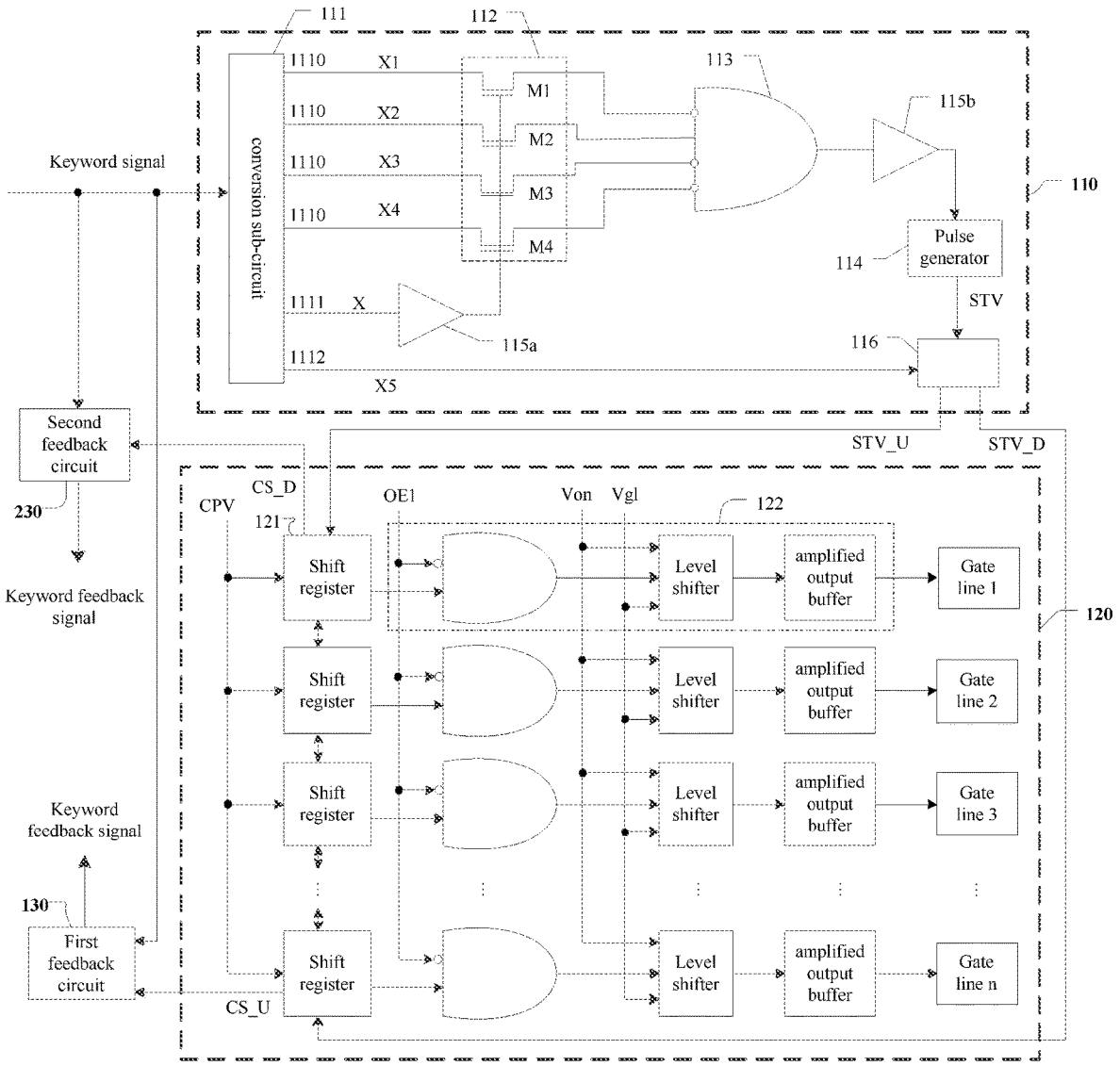
FIG. 9 is a structural schematic diagram of another scan driving circuit provided by an embodiment of the present disclosure.
Figure 10:
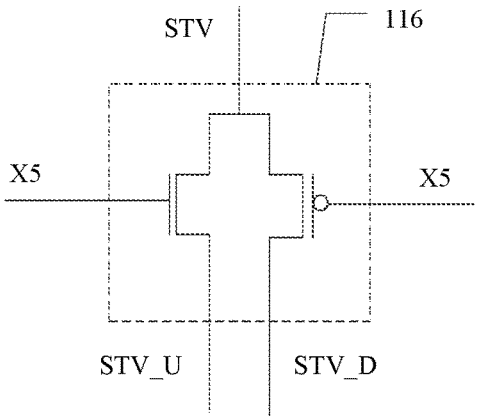
FIG. 10 is a structural schematic diagram of a direction selection sub-circuit provided by an embodiment of the present disclosure.
Figure 11:
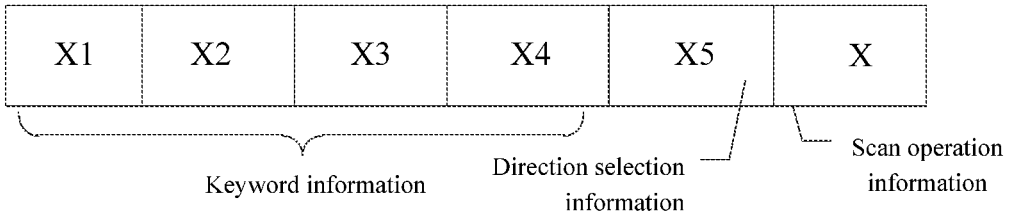
FIG. 11 is a schematic diagram of another keyword signal provided by an embodiment of the present disclosure.

FIG. 8 is a schematic block diagram of another scan driving circuit provided by an embodiment of the present disclosure; FIG. 9 is a structural schematic diagram of another scan driving circuit provided by an embodiment of the present disclosure; FIG. 10 is a structural schematic diagram of a direction selection sub-circuit provided by an embodiment of the present disclosure; FIG. 11 is a schematic diagram of another keyword signal provided by an embodiment of the present disclosure.

For example, as shown in FIG. 8, in a second example, the scan driving circuit further comprises a second feedback circuit group 23. The second feedback circuit group 23 includes a plurality of second feedback circuits 230 (for example, a second feedback circuit 230*a* and a second feedback circuit 230*b* as shown in FIG. 8) that are in one-to-one correspondence with the plurality of scanning circuits 120. For example, the respective second feedback circuits 230 are all electrically connected with the control circuit 10, to receive the keyword signals transmitted from the control circuit 10 and transmit keyword feedback signals to the control circuit 10; and the respective second feedback circuits 230 are further electrically connected with the respective scanning circuits 120 in one-to-one correspondence. In this case, the control circuit 10 may further control a scanning direction of the plurality of scanning circuits 120 determined according to a variation difference of adjacent frames. For example, the keyword signal may further be used for determining a scanning direction of the selected scanning circuit 120. The scanning direction may include, for example, forward scanning and backward scanning, and scanning directions of forward scanning and the backward scanning are opposite. As shown in FIG. 11, parallel information may be a six-bit binary number, and the parallel information may include the keyword information (e.g., X1, X2, X3 and X4), the scan operation information (e.g., X), and direction selection information. The direction selection information may include, for example, a one-bit binary number X5, and the direction selection information is used for determining the scanning direction of the selected scanning circuit 120. For detailed descriptions of the keyword information and the scan operation information, related descriptions in the example shown in FIG. 4 above may be referred to, and repeated parts will not be described here.

For example, as shown in FIG. 9, in the second example, each of the first processing circuits 110 further includes a direction selection sub-circuit 116, the direction selection sub-circuit 116 is configured to output the scan enable signal STV to different scan input terminals of the selected scanning circuit 120 according to the direction selection information, so as to control the scanning direction of the selected scanning circuit 120. For example, the selected scanning circuit 120 may include a forward scan input terminal and a backward scan input terminal; when X5=1, the direction selection sub-circuit 116 outputs a scan enable signal STV_U to the forward scan input terminal of the selected scanning circuit 120, so as to control the selected scanning circuit 120 to perform a forward scan operation; and when X5=0, the direction selection sub-circuit 116 outputs a scan enable signal STV_D to the backward scan input terminal of the selected scanning circuit 120, so as to control the selected scanning circuit 120 to perform a backward scan operation.

For example, as shown in FIG. 10, in one specific example, the direction selection sub-circuit 116 may be constituted by two transistors. Gate electrodes of the two transistors both receive the direction selection information, first electrodes of the two transistors both receive the scan enable signal STV, and second electrodes of the two transistors are respectively electrically connected with the forward scan input terminal and the backward scan input terminal of the scanning circuit 120, so as to respectively output the scan enable signal STV_U and the scan enable signal STV_D to the forward scan input terminal and the backward scan input terminal of the scanning circuit 120. For example, the two transistors are of opposite types, and under control of the direction selection information, one of the two transistors is turned on, and the other of the two transistors is turned off.

For example, as shown in FIG. 9, when the selected scanning circuit 120 completes the forward scan operation, the selected scanning circuit 120 is configured to output a scan completion signal CS_U to a corresponding first feedback circuit 130, the corresponding first feedback circuit 130 is configured to, in response to the scan completion signal CS_U and the keyword signal, generate a keyword feedback signal, and then output the keyword feedback signal to the control circuit 10; or, when the selected scanning circuit 120 completes the backward scan operation, the selected scanning circuit 120 is configured to output a scan completion signal CS_D to a corresponding second feedback circuit 230, and the corresponding second feedback circuit 230 is configured to, in response to the scan completion signal CS_D and the keyword signal, generate a keyword feedback signal, and then output the keyword feedback signal to the control circuit 10.

For example, circuit structures of the second feedback circuit 230 and the first feedback circuit 130 may be the same. The second feedback circuit 230 may also, for example, perform an operation of subtracting one on the scan operation information in the keyword signal, in response to the scan completion signal CS_D, so as to obtain the keyword feedback signal. The circuit structures of the second feedback circuit 230 and the first feedback circuit 130 may also be different, provided that a function of performing the operation of subtracting one on the scan operation information in the keyword signal may be implemented.

Figure 12:
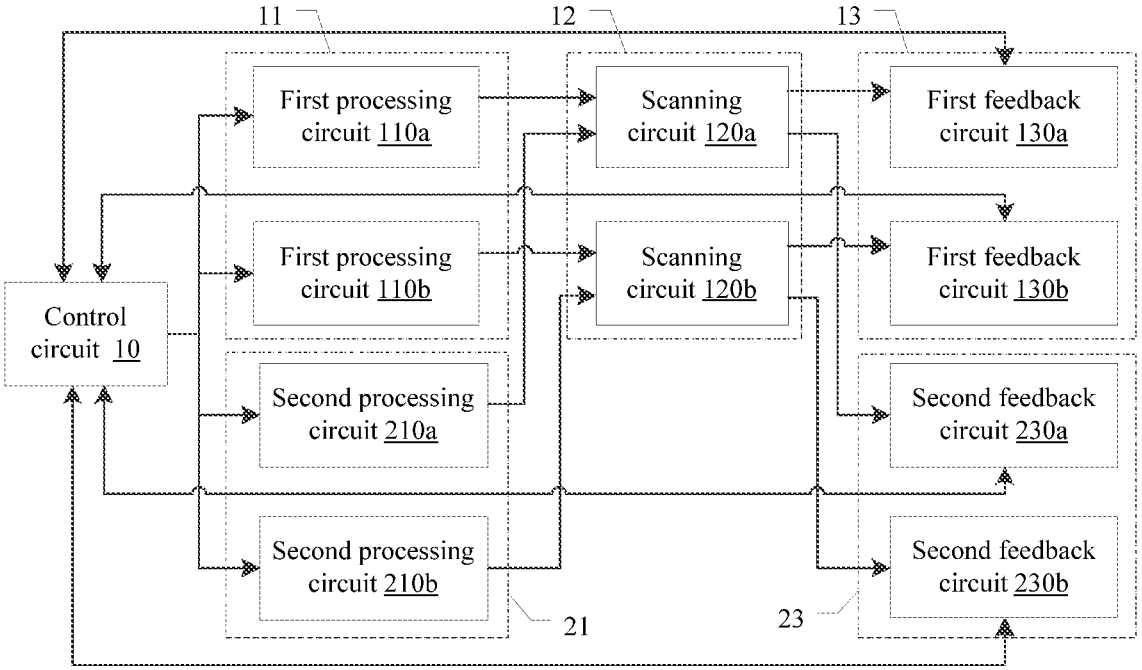
FIG. 12 is a schematic block diagram of still another scan driving circuit provided by an embodiment of the present disclosure.
Figure 13:
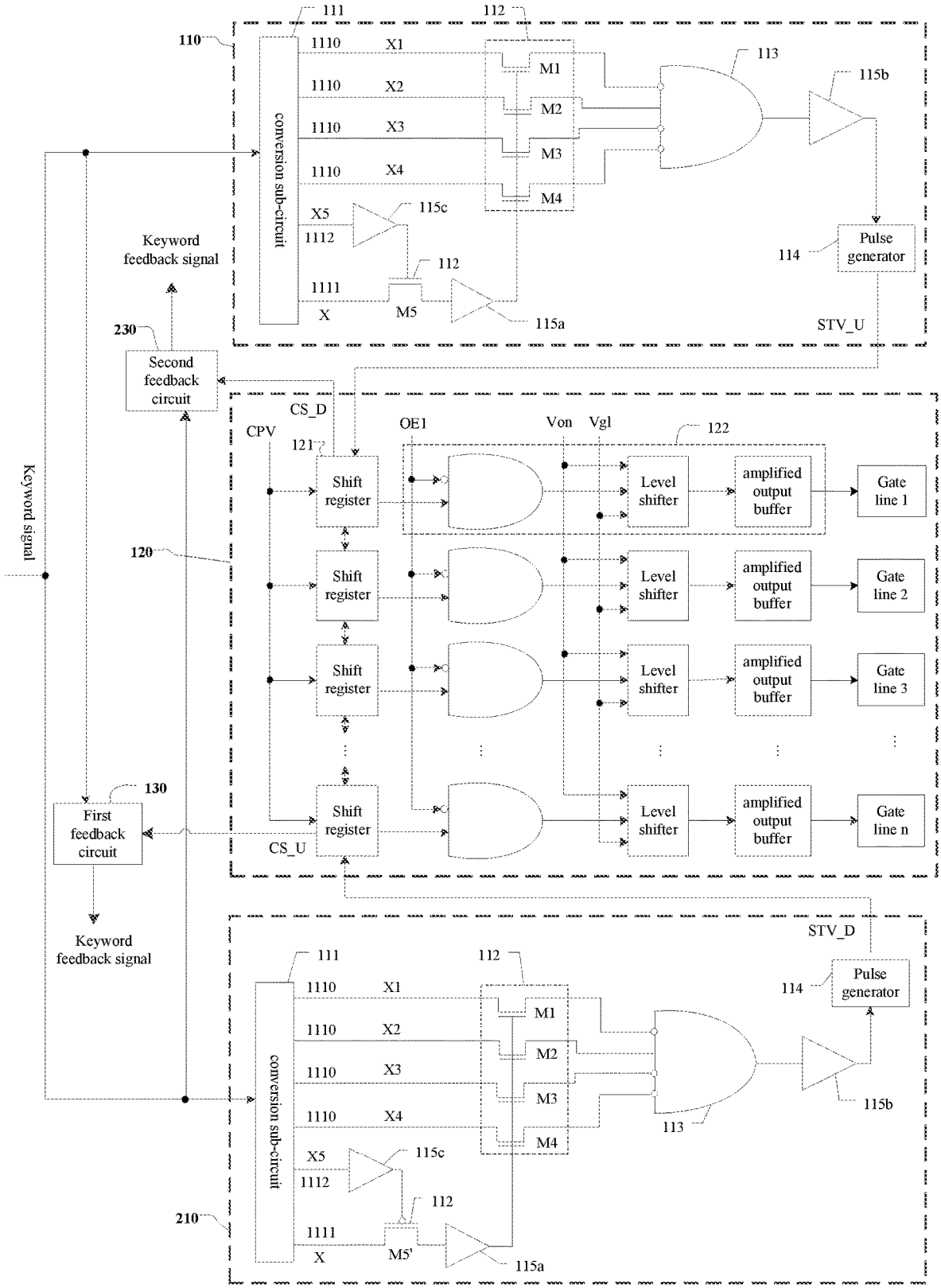
FIG. 13 is a structural schematic diagram of a first processing circuit, a scanning circuit and a second processing circuit in the scan driving circuit shown in FIG. 12.

FIG. 12 is a schematic block diagram of still another scan driving circuit provided by an embodiment of the present disclosure; FIG. 13 is a structural schematic diagram of a first processing circuit, a scanning circuit and a second processing circuit in the scan driving circuit shown in FIG. 12.

For example, as shown in FIG. 12, in a third example, the scan driving circuit further comprises a second processing circuit group 21. The second processing circuit group 21 includes a plurality of second processing circuits 210 (for example, a second processing circuit 210*a* and a second processing circuit 210*b* as shown in FIG. 12), and the plurality of second processing circuits 210 are electrically connected with the plurality of scanning circuits 120 in one-to-one correspondence. The control circuit 10 is respectively electrically connected with respective second processing circuits 210, and outputs the keyword signals to the respective second processing circuits 210.

For example, the respective first processing circuits 110 cause the scanning direction of the corresponding scanning circuits 120 to be forward scanning, and the respective second processing circuits 210 cause the scanning direction of the corresponding scanning circuits 120 to be backward scanning. As shown in FIG. 13, when the scanning direction is the forward scanning, the first processing circuit 110 electrically connected with the selected scanning circuit 120 is configured to receive the keyword signal and generate a scan enable signal STV_U, and then output the scan enable signal STV_U to the selected scanning circuit 120, to enable the selected scanning circuit 120 to perform forward scanning (meanwhile, the second processing circuit 210 electrically connected with the selected scanning circuit 120 does not output the scan enable signal STV_D); when the scanning direction is backward scanning, the second processing circuit 210 electrically connected with the selected scanning circuit 120 is configured to receive the keyword signal and generate the scan enable signal STV_D, and then output the scan enable signal STV_D to the selected scanning circuit 120, to enable the selected scanning circuit 120 to perform backward scanning (meanwhile, the first processing circuit 110 electrically connected with the selected scanning circuit 120 does not output the scan enable signal STV_U).

For example, as shown in FIG. 13, each of the first processing circuits 110 and each of the second processing circuits 210 both include a conversion sub-circuit 111, a switch sub-circuit 112, a judgment sub-circuit 113 and an output sub-circuit 114. The conversion sub-circuit 111 is configured to receive the keyword signal, and convert the series information in the keyword signal into the parallel information, the parallel information includes the keyword information (e.g., including the four binary numbers X1, X2, X3 and X4), the direction selection information (e.g., including the one binary number X5) and the scan operation information (e.g., including the one binary number X), and the conversion sub-circuit 111 is further configured to output the keyword information to the switch sub-circuit 112. For example, when the scan operation information indicates that the scan operation is started and the direction selection information indicates that forward scanning is performed, the switch sub-circuit 112 of the corresponding first processing circuit 110 is turned on and output the keyword information to the judgment sub-circuit 113 of the corresponding first processing circuit 110, the judgment sub-circuit 113 of the corresponding first processing circuit 110 generates a judgment result according to the keyword information and outputs the judgment result to the output sub-circuit 114 of the corresponding first processing circuit 110. When the scanning circuit 120 electrically connected with the corresponding first processing circuit 110 is selected to perform the forward scan operation, the judgment result is a turn-on signal; and when the judgment result is the turn-on signal, the output sub-circuit 114 of the corresponding first processing circuit 110 generates and outputs the scan enable signal STV_U according to the turn-on signal.

When the scan operation information indicates that the scan operation is started and the direction selection information indicates that backward scanning is performed, the switch sub-circuit 111 of the corresponding second processing circuit 210 is turned on and outputs the keyword information to the judgment sub-circuit 113 of the corresponding second processing circuit 210, the judgment sub-circuit 113 of the corresponding second processing circuit 210 generates a judgment result according to the keyword information and outputs the judgment result to the output sub-circuit 114 of the corresponding second processing circuit 210, when the scanning circuit 120 electrically connected with the corresponding second processing circuit 210 is selected to perform the backward scan operation, the judgment result is a turn-on signal; when the judgment result is the turn-on signal, the output sub-circuit 114 of the corresponding second processing circuit 210 generates and outputs the scan enable signal STV_D according to the turn-on signal.

For example, compared with the switch sub-circuit 112 shown in FIG. 9, in each of the first processing circuits 110, the switch sub-circuit 112 shown in FIG. 13 further includes a control transistor M5, and in each of the second processing circuits 210, the switch sub-circuit 112 further includes a control transistor M5'. In each of the first processing circuits 110 and each of the second processing circuits 210, the conversion sub-circuit 111 may further include a scan direction output terminal 1112. A first electrode of the control transistor M5/the control transistor M5' is electrically connected with the scan operation output terminal 1111 of the conversion sub-circuit 111, to receive the scan operation information; a gate electrode of the control transistor M5/the control transistor M5' is electrically connected with the scan direction output terminal 1112 of the conversion sub-circuit 111, to receive the direction selection information; and a second electrode of the control transistor M5/the control transistor M5' is electrically connected with gate electrodes of the respective switch transistors. It should be noted that, a type of the control transistor M5 in the first processing circuit 110 and a type of the control transistor M5' in the second processing circuit 210 are opposite. In FIG. 13, for example, the control transistor M5 in the first processing circuit 110 is an N-type transistor, and the control transistor M5' in the second processing circuit 210 is a P-type transistor.

For example, each of the first processing circuits 11 and each of the second processing circuits 210 further include a third amplifier 115*c*. The third amplifier 115*c* is used for amplifying the direction selection information, so that a voltage of the direction selection information reaches a turn-on voltage of the control transistor M5/the control transistor M5'.

For example, settings of the scanning circuit 120, the first feedback circuit 130, the conversion sub-circuit 111, the switch sub-circuit 112, the judgment sub-circuit 113, the output sub-circuit 114, and the like, may be referred to related descriptions in the first example (for example, related descriptions of the example shown in FIG. 4); related setting of the second feedback circuit 230 may be referred to related descriptions in the second example, and repeated parts will not be described here.

It should be noted that, in the second example and the third example, the scan driving circuit may also comprise only the first feedback circuit 130 or the second feedback circuit 230. Both the scan completion signal CS_U and the scan completion signal CS_D may be input to the first feedback circuit 130 or the second feedback circuit 230, so as to generate and output the keyword feedback signal to the control circuit 10.

Figure 14A:
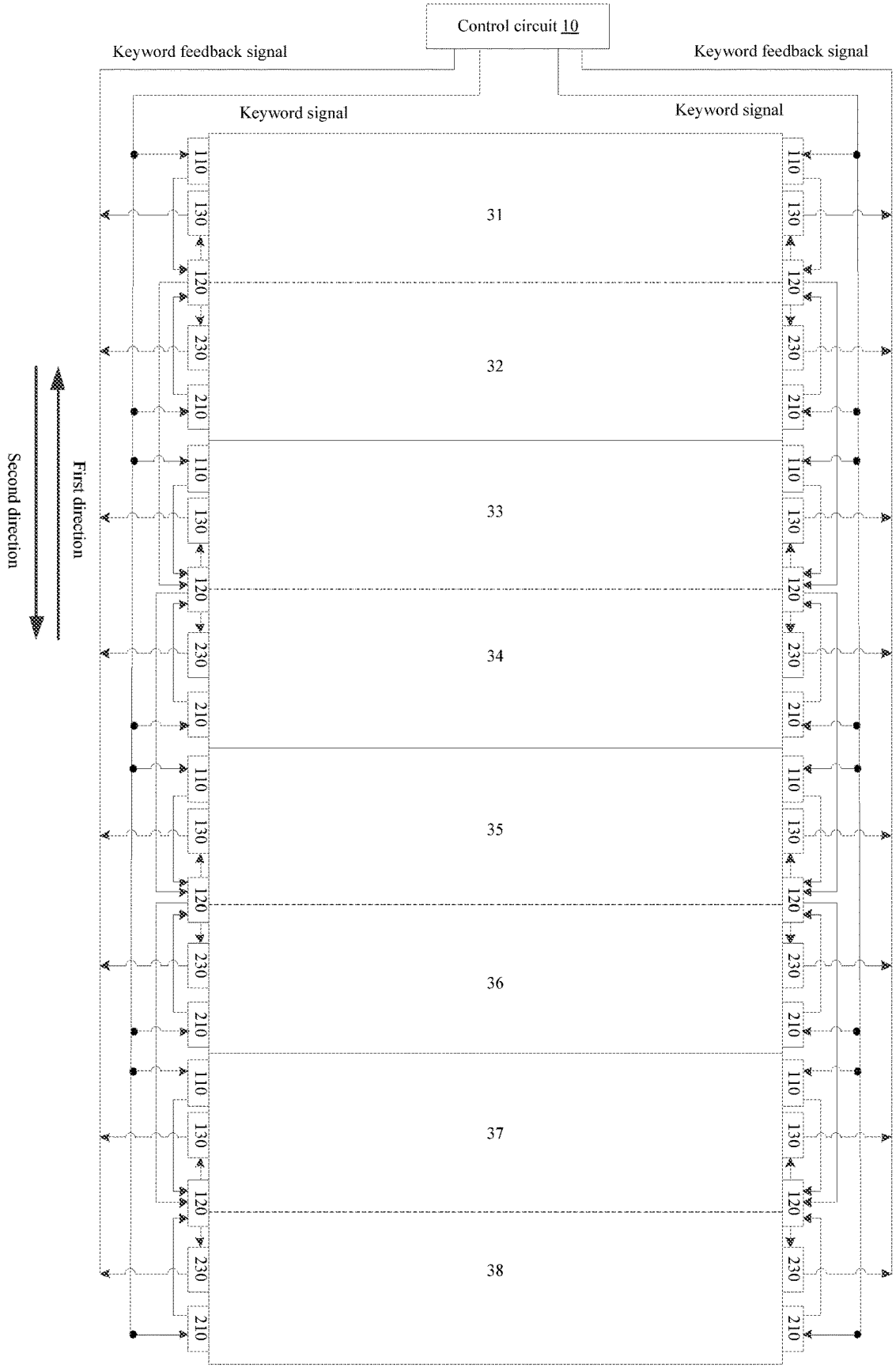
FIG. 14A is a plan schematic diagram of another display panel provided by an embodiment of the present disclosure.
Figure 14B:
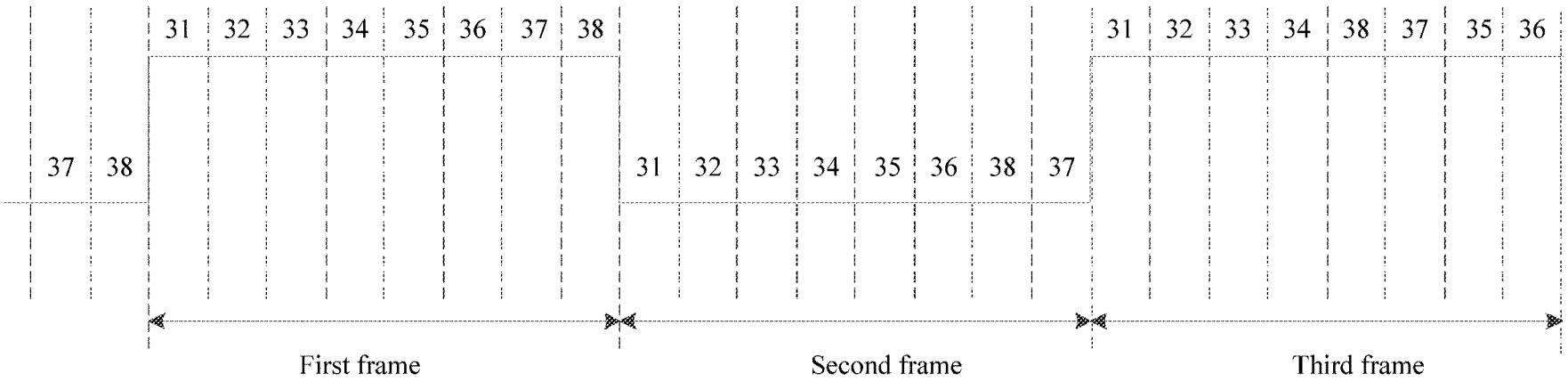
FIG. 14B is a schematic diagram of a scanning mode of another display panel provided by an embodiment of the present disclosure.
Figure 14C:
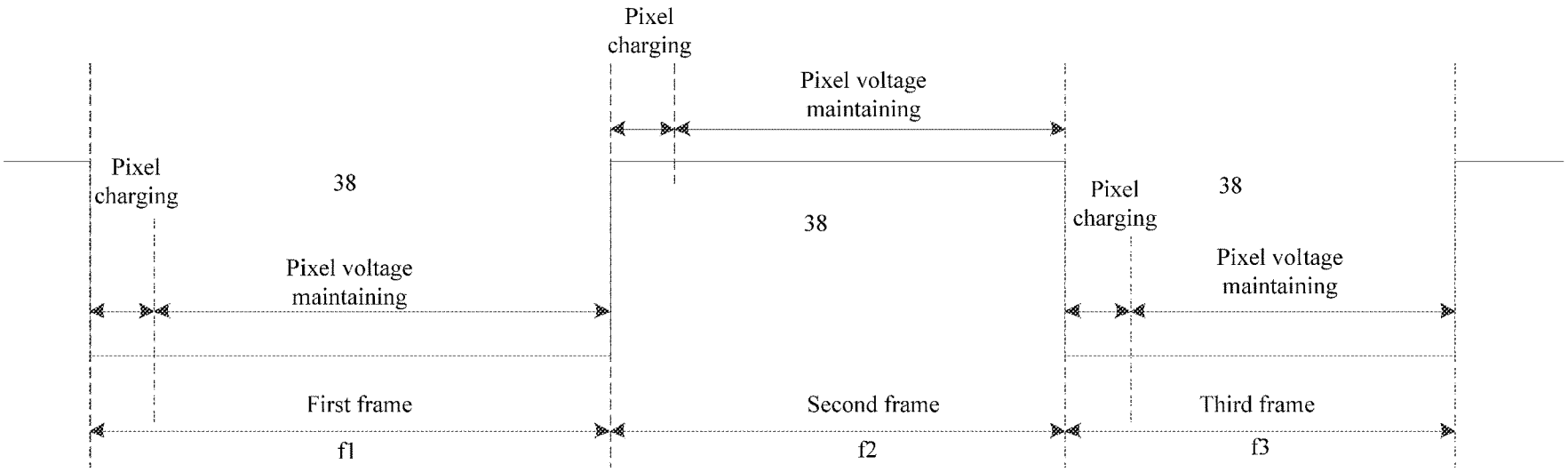
FIG. 14C is a schematic diagram of charging of a display region 38 shown in FIG. 14B.

FIG. 14A is a plan schematic diagram of another display panel provided by an embodiment of the present disclosure, FIG. 14B is a schematic diagram of a scanning mode of another display panel provided by an embodiment of the present disclosure, and FIG. 14C is a schematic diagram of charging of the display region 38 shown in FIG. 14B.

For example, as shown in FIG. 14A, in a first direction, the display panel may be divided into the first display region 31, the second display region 32, the third display region 33, the fourth display region 34, a fifth display region 35, a sixth display region 36, a seventh display region 37 and an eighth display region 38. For example, the first display region 31 and the second display region 32 correspond to a same scanning circuit 120 and a same first processing circuit 110; the third display region 33 and the fourth display region 34 correspond to a same scanning circuit 120 and a same first processing circuit 110; the fifth display region 35 and the sixth display region 36 correspond to a same scanning circuit 120 and a same first processing circuit 110; the seventh display region 37 and the eighth display region 38 correspond to a same scanning circuit 120 and a same first processing circuit 110.

For example, the forward scan operation indicates that the scanning direction is a second direction shown in FIG. 14A, and the backward scan operation indicates that the scanning direction is a first direction shown in FIG. 14A. For example, for the first display region 31 and the second display region 32, when the selected scanning circuit 120 performs the forward scan operation, the selected scanning circuit 120 firstly scans the first display region 31, and then scans the second display region 32; when the selected scanning circuit 120 performs the backward scan operation, the selected scanning circuit 120 firstly scans the second display region 32, and then scans the first display region 31.

For example, as shown in FIG. 14A to FIG. 14C, in one specific example, the scan driving circuit comprises four first processing circuits 110, four scanning circuits 120 and four first feedback circuits 130, and the display panel is divided into eight display regions. It is assumed that, by comparing a variation difference of pictures in the eight display regions, it is found that, with respect to the scanning time of the first frame, during the scanning time of the second frame, a variation difference of the display pictures in the eighth display region 38 is larger than that of other display regions; and thus, during the scanning time of the second frame, the control circuit 10 may adjust the scanning direction of the scanning circuit 120 corresponding to the seventh display region 37 and the eighth display region 38, to change the scanning direction from forward scanning to backward scanning.

For example, as shown in FIG. 14B, during the scanning time of the first frame, the scan order of the respective display regions is that scanning is sequentially performed from the first display region 31 to the eighth display region 38, the scanning directions of the respective display regions are all forward scanning, and a pixel refresh frequency of the eighth display region 38 may be f1; and during the scanning time of the second frame, the scan order of the respective display regions remains unchanged, but the scanning direction of the scanning circuit 120 corresponding to the seventh display region 37 and the eighth display region 38 changes, and the scanning direction changes from forward scanning to backward scanning, so that a pixel refresh frequency of the eighth display region 38 is increased, and may be f2, where f2 is greater than f1, so as to increase a response speed of a display picture of the eighth display region 38, and improve the quality of the display picture.

For example, as shown in FIG. 14C, taking the eighth display region 38 as an example, during the scanning time of the second frame, a pixel charging process of the eighth display region 38 is advanced, and pixel charging time of the eighth display region 38 remains unchanged, but pixel voltage maintaining time is decreased, so that the pixel refresh frequency of the eighth display region 38 is increased.

For example, if, relative to the scanning time of the second frame, within the scanning time of a third frame, a variation difference of the display picture of the eighth display region 38 is still larger than that of other display regions, then the scanning position of the eighth display region 38 still needs to be shifted forward; because the seventh display region 37 and the eighth display region 38 correspond to one scanning circuit 120, that is, the seventh display region 37 and the eighth display region 38 need to continuously perform scan operations, so that during the scanning time of the third frame, the scan order of the respective display regions needs to be changed, and the scanning position of the scanning circuit 120 corresponding to the seventh display region 37 and the eighth display region 38 is, for example, shifted forward by one position. During the scanning time of the third frame, the pixel refresh frequency of the eighth display region 38 is further increased, and may be f3, where f3 is greater than f2.

For example, according to an actual situation, the scanning position of the scanning circuit 120 corresponding to the seventh display region 37 and the eighth display region 38 may also be shifted forward by two positions, three positions, etc.

For example, in the example shown in FIG. 14A, the scan driving circuit may further implement co-directional sequential scanning. As shown in FIG. 14A, the respective scanning circuits 120 may be electrically connected with each other, and after the scanning circuit 120 completes the scan operation, the scanning circuit 120 transmits the scan completion signal to a next scanning circuit 120 adjacent thereto, to drive the next scanning circuit 120 to perform a scan operation, so as to implement the co-directional sequential scanning.

It should be noted that, in FIG. 14A, each display region may be provided with first processing circuits 110, first feedback circuits 130, second processing circuits 210, second feedback circuits 230 and scanning circuits 120 on both sides thereof, so that bilateral scan driving may be implemented. However, the present disclosure is not limited thereto, each display region may further be provided with a first processing circuit 110, a first feedback circuit 130, a second processing circuit 210, a second feedback circuit 230 and a scanning circuit 120 on only one side thereof, so as to implement unilateral scanning. For example, the corresponding first processing circuits 110, first feedback circuits 130, second processing circuits 210, second feedback circuits 230 and scanning circuits 120 may be integrated in one chip.

In summary, in the scan driving circuit provided by the embodiment of the present disclosure, during scanning time of each frame, the scan order and/or the scanning direction of the respective scanning circuits 120 may be rearranged according to a variation difference of the display pictures of adjacent frames, so as to dynamically increase the refresh frequency of a display region where a variation difference of the display pictures is relatively large without changing an overall scanning frequency, improve the response speed of the display picture, and improve the quality of the display picture.

It should be noted that, the scan order and/or the scanning direction of the respective scanning circuits 120 may further be determined by other ways, for example, according to sizes of the respective display regions. The embodiment of the present disclosure is not specifically limited thereto.

Figure 15:
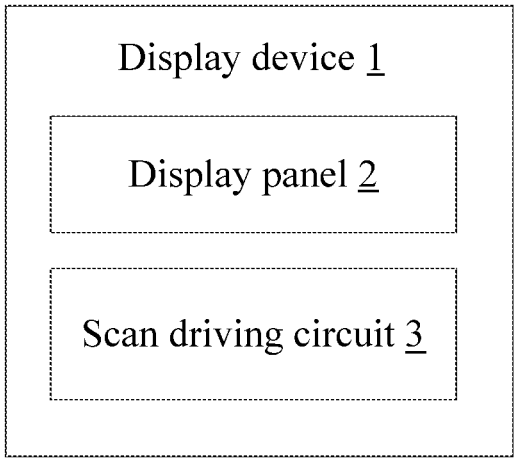
FIG. 15 is a schematic block diagram of a display device provided by another embodiment of the present disclosure.

An embodiment of the present disclosure further provides a display device. FIG. 15 is a schematic block diagram of a display device provided by another embodiment of the present disclosure.

For example, as shown in FIG. 15, a display device 1 may comprise a display panel 2 and a scan driving circuit 3 provided by any one of the embodiments of the present disclosure. The scan driving circuit 3 is electrically connected with the display panel 2, and the scan driving circuit 3 is configured to sequentially output scanning signals to the display panel 2, so that thin film transistors in respective rows in the display panel 2 are sequentially turned on.

For example, the display panel 2 may be a liquid crystal display panel, an organic light-emitting display panel, and the like.

For example, the display device 1 may comprise any products or components having a display function such as a mobile phone, a tablet, a television, a monitor, a notebook computer, a digital photo frame, a navigator, or the like.

Figure 16:
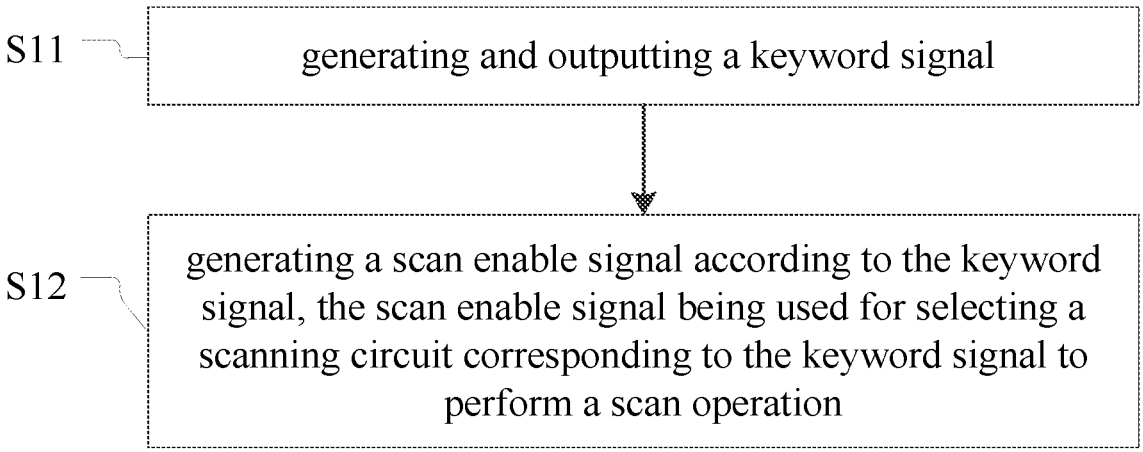
FIG. 16 is a schematic flow chart of a driving method of a scan driving circuit provided by still another embodiment of the present disclosure.

An embodiment of the present disclosure further provides a driving method for the scan driving circuit according to any one of the above embodiments. FIG. 16 is a schematic flow chart of a driving method of a scan driving circuit provided by still another embodiment of the present disclosure.

For example, as shown in FIG. 16, a driving method of the scan driving circuit may comprise following operations:

S11: generating and outputting a keyword signal;

S12: generating a scan enable signal according to the keyword signal, the scan enable signal being used for selecting a scanning circuit corresponding to the keyword signal to perform a scan operation.

For example, the scan driving circuit includes a control circuit and a scanning circuit group, and the scanning circuit group includes a plurality of scanning circuits. The control circuit is used to generate and output the keyword signal, and the keyword signal may be used to identify a selected scanning circuit.

For example, before the operation S11 is performed, the driving method of the scan driving circuit may further comprise a following operation: dividing the display panel into a plurality of display regions, and determining a scan order of the plurality of scanning circuits corresponding to the plurality of display regions, according to a variation difference of adjacent frames in the plurality of display regions.

For example, the scan order of the plurality of scanning circuits may determine an output order of keyword signals, so that the plurality of scanning circuits perform scan operations in order.

For example, in one example, the scan driving circuit includes a first processing circuit group, the first processing circuit group includes a plurality of first processing circuits, and the plurality of first processing circuits are electrically connected with the plurality of scanning circuits in one-to-one correspondence. A first processing circuit electrically connected with the selected scanning circuit is a selected first processing circuit. When the keyword signal is input to the selected first processing circuit, the selected first processing circuit may generate and output a scan enable signal to the selected scanning circuit, to control the selected scanning circuit to perform the scan operation.

For example, the keyword signal may further determine a scanning direction of the selected scanning circuit. According to the keyword signal, the scan enable signal may further control the scanning circuit to perform a forward scan operation or a backward scan operation.

For example, in one example, each of the first processing circuits may include a direction selection sub-circuit. When the keyword signal determines that the scanning circuit performs the forward scan operation, a direction selection sub-circuit of the selected first processing circuit may transmit the scan enable signal to a forward scan input terminal of the selected scanning circuit, to control the selected scanning circuit to perform the forward scan operation; and when the keyword signal determines that the scanning circuit performs the backward scan operation, the direction selection sub-circuit of the selected first processing circuit may transmit the scan enable signal to the backward scan input terminal of the selected scanning circuit, to control the selected scanning circuit to perform the backward scan operation.

For example, in one example, the scan driving circuit further comprises a second processing circuit group, the second processing circuit group includes a plurality of second processing circuits, and the plurality of second processing circuits are also electrically connected with the plurality of scanning circuits in one-to-one correspondence. A second processing circuit electrically connected with the selected scanning circuit is a selected second processing circuit. When the keyword signal determines that the scanning circuit performs the forward scan operation, the selected first processing circuit may generate and output the scan enable signal to the forward scan input terminal of the selected scanning circuit, to control the selected scanning circuit to perform the forward scan operation; and when the keyword signal determines that the scanning circuit performs the backward scan operation, the selected second processing circuit may generate and output the scan enable signal to the backward scan input terminal of the selected scanning circuit, to control the selected scanning circuit to perform the backward scan operation.

For example, after the operation S12 is ended, the driving method of the scan driving circuit may further comprise a following operation: generating a keyword feedback signal upon the scanning circuit completing the scan operation; and generating a next keyword signal, according to the keyword feedback signal and the scan order of the plurality of scanning circuits.

For example, in one example, the scan driving circuit comprises a first feedback circuit group, and the first feedback circuit group includes a plurality of first feedback circuits that are in one-to-one correspondence with the plurality of scanning circuits. The plurality of first feedback circuits are all electrically connected with the control circuit, to receive the keyword signals and transmit the keyword feedback signals. A first feedback circuit electrically connected with the selected scanning circuit is a selected first feedback circuit. For example, when the selected scanning circuit completes the scan operation, the selected scanning circuit may output a scan completion signal to the selected first feedback circuit, and the selected first feedback circuit generates and outputs the keyword feedback signal to the control circuit in response to the keyword signal and the scan completion signal, so that the control circuit may generate a next keyword according to the keyword feedback signal and the scan order of the plurality of scanning circuits.

For example, in one example, the scan driving circuit further comprises a second feedback circuit group, and the second feedback circuit group includes a plurality of second feedback circuits that are in one-to-one correspondence with the plurality of scanning circuits. A second feedback circuit electrically connected with the selected scanning circuit is a selected second feedback circuit. The plurality of second feedback circuits are all electrically connected with the control circuit, to receive the keyword signals and transmit the keyword feedback signals. For example, when the selected scanning circuit completes the forward scan operation, the selected scanning circuit may output the scan completion signal to the selected first feedback circuit, and the selected first feedback circuit generates and outputs the keyword feedback signal to the control circuit in response to the keyword signal and the scan completion signal; or; when the selected scanning circuit completes the backward scan operation, the selected scanning circuit may output the scan completion signal to the selected second feedback circuit, and the selected second feedback circuit generates and outputs the keyword feedback signal to the control circuit in response to the keyword signal and the scan completion signal. The control circuit may generate a next keyword signal, according to the keyword feedback signal and the scan order and the scanning direction of the plurality of scanning circuits.

For example, after the scanning time of one frame is ended, the driving method of the scan driving circuit may comprise a following operation: re-acquiring a comparison result of a variation difference of display pictures of adjacent frames in different display regions; rearranging the scan order and/or the scanning direction of the respective display regions according to the variation difference of the display pictures.

The driving method provided by the embodiment of the present disclosure may adjust the scan order and the scanning mode of the plurality of scanning circuits in real time according to a variation difference of display pictures of adjacent frames, so as to dynamically increase a refresh frequency of the display picture of the corresponding display region without changing an overall scanning frequency of a display panel, increase a response speed of the display picture, and improve a display quality of the display picture.

For the present disclosure, the following statements should be noted:

(1) the accompanying drawings involve only the structure(s) in connection with the embodiment(s) of the present disclosure, and other structure(s) can be referred to in common design(s); and (2) in case of no conflict, the embodiments of the present disclosure and the features in the embodiment(s) can be combined with each other to obtain new embodiment(s).

What have been described above are only specific implementations of the present disclosure, the protection scope of the present disclosure is not limited thereto. Any modifications or substitutions that easily occur to those skilled in the art within the technical scope of the present disclosure should be within the protection scope of the present disclosure. Therefore, the protection scope of the present disclosure should be based on the protection scope of the claims.

What is claimed is:

1. A scan driving circuit, comprising: a control circuit, a scanning circuit group and a first processing circuit group, wherein the control circuit is configured to generate and output a keyword signal to the first processing circuit group, to control a scan order of respective scanning circuits in the scanning circuit group; and the first processing circuit group is configured to generate a scan enable signal according to the keyword signal, and output the scan enable signal to a scanning circuit corresponding to the keyword signal in the scanning circuit group, the scanning circuit group comprises a plurality of scanning circuits;

the first processing circuit group comprises a plurality of first processing circuits, and the plurality of first processing circuits are electrically connected with the plurality of scanning circuits in one-to-one correspondence;

the control circuit is electrically connected with the plurality of first processing circuits respectively, and outputs the keyword signal to the plurality of first processing circuits;

the plurality of scanning circuits are in one-to-one correspondence with a plurality of display regions, the control circuit is further configured to determine a scan order of the plurality of scanning circuits according to a plurality of variation differences, which are in one-to-one correspondence to the plurality of display regions, of adjacent frames; and a variation difference corresponding to a display region represents a difference between a display picture of the display region in one frame of the adjacent frames and a display picture of the display region in another frame of the adjacent frames.

2. The scan driving circuit according to claim 1, wherein, the keyword signal is used for identifying a selected scanning circuit;

a first processing circuit, which is electrically connected with the selected scanning circuit, in the plurality of first processing circuits is configured to:

receive the keyword signal output from the control circuit and generate the scan enable signal, and output the scan enable signal to the selected scanning circuit, to enable the selected scanning circuit to perform a scan operation.

3. The scan driving circuit according to claim 2, further comprising a first feedback circuit group, wherein the first feedback circuit group comprises a plurality of first feedback circuits that are in one-to-one correspondence with the plurality of scanning circuits;

the plurality of first feedback circuits are electrically connected with the control circuit, to receive the keyword signal;

the selected scanning circuit is configured to, in response to the selected scanning circuit completing the scan operation, output a scan completion signal to a corresponding first feedback circuit in the plurality of first feedback circuits;

the corresponding first feedback circuit is configured to, in response to the scan completion signal, generate and output a keyword feedback signal to the control circuit.

4. The scan driving circuit according to claim 2, wherein each of the plurality of first processing circuits comprises a conversion sub-circuit, a switch sub-circuit, a judgment sub-circuit and an output sub-circuit, the conversion sub-circuit is configured to receive the keyword signal, and convert series information in the keyword signal to parallel information, the parallel information comprises keyword information and scan operation information, and the conversion sub-circuit is further configured to output the keyword information to the switch sub-circuit, when the scan operation information indicates that the scan operation is started, the switch sub-circuit is turned on and outputs the keyword information to the judgment sub-circuit, the judgment sub-circuit generates a judgment result according to the keyword information and outputs the judgment result to the output sub-circuit, wherein when a scanning circuit corresponding thereto is selected to perform a scan operation, the judgment result is a turn-on signal;

when the judgment result is the turn-on signal, the output sub-circuit outputs the scan enable signal.

5. The scan driving circuit according to claim 4, wherein, the switch sub-circuit comprises a plurality of switch transistors, an amount of the plurality of switch transistors is equal to an amount of bits of the keyword information;

a gate electrode of each of the plurality of switch transistors is electrically connected with a scan operation output terminal of the conversion sub-circuit, to receive the scan operation information;

a first electrode of each of the plurality of switch transistors is electrically connected with a corresponding keyword output terminal of the conversion sub-circuit, to receive one bit of the keyword information;

a second electrode of each of the plurality of switch transistors is electrically connected with the judgment sub-circuit;

the judgment sub-circuit comprises an AND gate, the output sub-circuit comprises a pulse generator, and an output terminal of the judgment sub-circuit is electrically connected with the output sub-circuit.

6. The scan driving circuit according to claim 4, wherein the parallel information further includes direction selection information, each of the plurality of first processing circuits further comprises a direction selection sub-circuit, and the direction selection sub-circuit is configured to determine a scanning direction of the selected scanning circuit according to the direction selection information.

7. The scan driving circuit according to claim 1, further comprising a second processing circuit group, wherein the second processing circuit group comprises a plurality of second processing circuits, and the plurality of second processing circuits are electrically connected with the plurality of scanning circuits in one-to-one correspondence;

the control circuit is respectively electrically connected with the plurality of second processing circuits, and outputs the keyword signal to the plurality of second processing circuits.

8. The scan driving circuit according to claim 7, wherein the plurality of first processing circuits cause scanning directions of corresponding scanning circuits to be forward scanning, and the plurality of second processing circuits cause the scanning directions of the corresponding scanning circuits to be backward scanning;

the keyword signal is used for identifying a selected scanning circuit and determining a scanning direction of the selected scanning circuit, the scanning direction is the forward scanning or the backward scanning;

when the scanning direction is the forward scanning, a first processing circuit, which is electrically connected with the selected scanning circuit, in the plurality of first processing circuits is configured to:

receive the keyword signal output from the control circuit and generate the scan enable signal; and output the scan enable signal to the selected scanning circuit, to enable the selected scanning circuit to perform a forward scan operation;

when the scanning direction is the backward scanning, a second processing circuit, which is electrically connected with the selected scanning circuit, in the plurality of second processing circuits is configured to:

receive the keyword signal output from the control circuit and generate the scan enable signal, and output the scan enable signal to the selected scanning circuit, to enable the selected scanning circuit to perform a backward scan operation.

9. The scan driving circuit according to claim 8, further comprising a first feedback circuit group and a second feedback circuit group, wherein the first feedback circuit group comprises a plurality of first feedback circuits that are in one-to-one correspondence with the plurality of scanning circuits, and the second feedback circuit group also comprises a plurality of second feedback circuits that are in one-to-one correspondences with the plurality of scanning circuits, the plurality of second feedback circuits are all electrically connected with the control circuit, to receive the keyword signal;

the selected scanning circuit is configured, in response to the selected scanning circuit completing the forward scan operation, to output a scan completion signal to a corresponding first feedback circuit in the plurality of first feedback circuits, and the corresponding first feedback circuit is configured to, in response to the scan completion signal, generate and output a keyword feedback signal to the control circuit; or the selected scanning circuit is configured to, in response to the selected scanning circuit completing the backward scan operation, output the scan completion signal to a corresponding second feedback circuit in the plurality of second feedback circuits, and the corresponding second feedback circuit is configured to, in response to the scan completion signal, generate and output a keyword feedback signal to the control circuit.

10. The scan driving circuit according to claim 8, wherein, each of the plurality of first processing circuits and each of the plurality of second processing circuits both comprise a conversion sub-circuit, a switch sub-circuit, a judgment sub-circuit and an output sub-circuit;

the conversion sub-circuit is configured to receive the keyword signal, and convert series information in the keyword signal into parallel information, the parallel information comprises keyword information, scan operation information, and direction selection information, and the conversion sub-circuit is further configured to output the keyword information to the switch sub-circuit;

when the scan operation information indicates that a scan operation is started and the direction selection information indicates that the forward scanning is performed:

a switch sub-circuit of a corresponding first processing circuit in the plurality of first processing circuits is turned on and outputs the keyword information to a judgment sub-circuit of the corresponding first processing circuit, the judgment sub-circuit of the corresponding first processing circuit generates a judgment result according to the keyword information and outputs the judgment result to an output sub-circuit of the corresponding first processing circuit, wherein when a scanning circuit electrically connected with the corresponding first processing circuit is selected to perform the forward scan operation, the judgment result is a turn-on signal; and when the judgment result is the turn-on signal, the output sub-circuit of the corresponding first processing circuit outputs the scan enable signal according to the turn-on signal;

when the scan operation information indicates that the scan operation is started and the direction selection information indicates that the backward scanning is performed:

a switch sub-circuit of a corresponding second processing circuit in the plurality of second processing circuits is turned on and outputs the keyword information to a judgment sub-circuit of the corresponding second processing circuit, the judgment sub-circuit of the corresponding second processing circuit generates a judgment result according to the keyword information and outputs the judgment result to an output sub-circuit of the corresponding second processing circuit, and when a scanning circuit electrically connected with the corresponding second processing circuit is selected to perform the backward scan operation, the judgment result is a turn-on signal; and when the judgment result is the turn-on signal, the output sub-circuit of the corresponding second processing circuit outputs the scan enable signal according to the turn-on signal.

11. The scan driving circuit according to claim 10, wherein, the switch sub-circuit comprises a plurality of switch transistors and a control transistor, an amount of the plurality of switch transistors is equal to an amount of bits of the keyword information;

a first electrode of the control transistor is electrically connected with a scan operation output terminal of the conversion sub-circuit, to receive the scan operation information; a gate electrode of the control transistor is electrically connected with a scanning direction output terminal of the conversion sub-circuit, to receive the direction selection information; a second electrode of the control transistor is respectively electrically connected with gate electrodes of the plurality of switch transistors;

a first electrode of each of the plurality of switch transistors is electrically connected with a corresponding keyword output terminal of the conversion sub-circuit, to receive one bit of the keyword information;

a second electrode of each of the plurality of switch transistors is electrically connected with the judgment sub-circuit;

the judgment sub-circuit comprises an AND gate, the output sub-circuit comprises a pulse generator, and an output terminal of the judgment sub-circuit is electrically connected with the output sub-circuit.

12. The scan driving circuit according to claim 1, wherein the control circuit is further configured to receive a keyword feedback signal from a first feedback circuit or a second feedback circuit, and generate a next keyword signal according to the scan order of the plurality of scanning circuits and the keyword feedback signal.

13. A display device, comprising a display panel and the scan driving circuit according to claim 1.

14. A driving method of the scan driving circuit according to claim 1, comprising:

generating and outputting the keyword signal; and generating the scan enable signal according to the keyword signal, the scan enable signal being used for selecting a scanning circuit corresponding to the keyword signal to perform a scan operation.

15. The driving method according to claim 14, further comprising:

determining a scan order of the plurality of scanning circuits according to the plurality of variation differences, which are in one-to-one correspondence to the plurality of display regions, of adjacent frames;

generating a next keyword signal according to a keyword feedback signal and the scan order of the plurality of scanning circuits.

16. The driving method according to claim 14, wherein the scan enable signal is further configured to control the scanning circuit to perform forward scanning or backward scanning.

17. The scan driving circuit according to claim 3, wherein each of the plurality of first processing circuits comprises a conversion sub-circuit, a switch sub-circuit, a judgment sub-circuit and an output sub-circuit, the conversion sub-circuit is configured to receive the keyword signal, and convert series information in the keyword signal to parallel information, the parallel information comprises keyword information and scan operation information, and the conversion sub-circuit is further configured to output the keyword information to the switch sub-circuit, when the scan operation information indicates that the scan operation is started, the switch sub-circuit is turned on and outputs the keyword information to the judgment sub-circuit, the judgment sub-circuit generates a judgment result according to the keyword information and outputs the judgment result to the output sub-circuit, wherein when a scanning circuit corresponding thereto is selected to perform a scan operation, the judgment result is a turn-on signal;

when the judgment result is the turn-on signal, the output sub-circuit outputs the scan enable signal.

18. The scan driving circuit according to claim 5, wherein the parallel information further includes direction selection information, each of the plurality of first processing circuits further comprises a direction selection sub-circuit, and the direction selection sub-circuit is configured to determine a scanning direction of the selected scanning circuit according to the direction selection information.

19. A scan driving circuit, comprising: a control circuit, a scanning circuit group and a first processing circuit group, wherein the control circuit is configured to generate and output a keyword signal to the first processing circuit group, to control a scan order of respective scanning circuits in the scanning circuit group; and the first processing circuit group is configured to generate a scan enable signal according to the keyword signal, and output the scan enable signal to a scanning circuit corresponding to the keyword signal in the scanning circuit group, the scanning circuit group comprises a plurality of scanning circuits;

the first processing circuit group comprises a plurality of first processing circuits, and the plurality of first processing circuits are electrically connected with the plurality of scanning circuits in one-to-one correspondence;

the control circuit is electrically connected with the plurality of first processing circuits respectively, and outputs the keyword signal to the plurality of first processing circuits;

the keyword signal is used for identifying a selected scanning circuit;

a first processing circuit, which is electrically connected with the selected scanning circuit, in the plurality of first processing circuits is configured to:

receive the keyword signal output from the control circuit and generate the scan enable signal, and output the scan enable signal to the selected scanning circuit, to enable the selected scanning circuit to perform a scan operation;

each of the plurality of first processing circuits comprises a conversion sub-circuit, a switch sub-circuit, a judgment sub-circuit and an output sub-circuit, the conversion sub-circuit is configured to receive the keyword signal, and convert series information in the keyword signal to parallel information, the parallel information comprises keyword information and scan operation information, and the conversion sub-circuit is further configured to output the keyword information to the switch sub-circuit, when the scan operation information indicates that the scan operation is started, the switch sub-circuit is turned on and outputs the keyword information to the judgment sub-circuit, the judgment sub-circuit generates a judgment result according to the keyword information and outputs the judgment result to the output sub-circuit, wherein when a scanning circuit corresponding thereto is selected to perform a scan operation, the judgment result is a turn-on signal;

when the judgment result is the turn-on signal, the output sub-circuit outputs the scan enable signal, the switch sub-circuit comprises a plurality of switch transistors, an amount of the plurality of switch transistors is equal to an amount of bits of the keyword information;

a gate electrode of each of the plurality of switch transistors is electrically connected with a scan operation output terminal of the conversion sub-circuit, to receive the scan operation information;

a first electrode of each of the plurality of switch transistors is electrically connected with a corresponding keyword output terminal of the conversion sub-circuit, to receive one bit of the keyword information;

a second electrode of each of the plurality of switch transistors is electrically connected with the judgment sub-circuit;

the judgment sub-circuit comprises an AND gate, the output sub-circuit comprises a pulse generator, and an output terminal of the judgment sub-circuit is electrically connected with the output sub-circuit.

20. A scan driving circuit, comprising: a control circuit, a scanning circuit group and a first processing circuit group, wherein the control circuit is configured to generate and output a keyword signal to the first processing circuit group, to control a scan order of respective scanning circuits in the scanning circuit group; and the first processing circuit group is configured to generate a scan enable signal according to the keyword signal, and output the scan enable signal to a scanning circuit corresponding to the keyword signal in the scanning circuit group, the scanning circuit group comprises a plurality of scanning circuits;

the first processing circuit group comprises a plurality of first processing circuits, and the plurality of first processing circuits are electrically connected with the plurality of scanning circuits in one-to-one correspondence;

the control circuit is electrically connected with the plurality of first processing circuits respectively, and outputs the keyword signal to the plurality of first processing circuits;

the scan driving circuit further comprises a second processing circuit group, wherein the second processing circuit group comprises a plurality of second processing circuits, and the plurality of second processing circuits are electrically connected with the plurality of scanning circuits in one-to-one correspondence;

the control circuit is respectively electrically connected with the plurality of second processing circuits, and outputs the keyword signal to the plurality of second processing circuits, the plurality of first processing circuits cause scanning directions of corresponding scanning circuits to be forward scanning, and the plurality of second processing circuits cause the scanning directions of the corresponding scanning circuits to be backward scanning;

the keyword signal is used for identifying a selected scanning circuit and determining a scanning direction of the selected scanning circuit, the scanning direction is the forward scanning or the backward scanning;

when the scanning direction is the forward scanning, a first processing circuit, which is electrically connected with the selected scanning circuit, in the plurality of first processing circuits is configured to:

receive the keyword signal output from the control circuit and generate the scan enable signal; and output the scan enable signal to the selected scanning circuit, to enable the selected scanning circuit to perform a forward scan operation;

when the scanning direction is the backward scanning, a second processing circuit, which is electrically connected with the selected scanning circuit, in the plurality of second processing circuits is configured to:

receive the keyword signal output from the control circuit and generate the scan enable signal, and output the scan enable signal to the selected scanning circuit, to enable the selected scanning circuit to perform a backward scan operation.

* * * * *